US005588065A

United States Patent [19]

Tanaka et al.

[11] Patent Number: 5,588,065

[45] Date of Patent: Dec. 24, 1996

[54] BASS REPRODUCTION SPEAKER APPARATUS

[75] Inventors: Shoji Tanaka, Kobe; Katsuhiko Iimura, Osaka; Satoshi Kageyama, Takatsuki, all of Japan

[73] Assignee: Masushita Electric Industrial Co., Kadoma, Japan

[21] Appl. No.: 447,429

[22] Filed: May 23, 1995

Related U.S. Application Data

[63] Continuation of Ser. No. 992,028, Dec. 17, 1992.

[30] Foreign Application Priority Data

| | | | |
|---|---|---|---|
| Dec. 20, 1991 | [JP] | Japan | 3-338093 |
| Dec. 20, 1991 | [JP] | Japan | 3-338094 |
| Dec. 25, 1991 | [JP] | Japan | 3-342676 |
| Dec. 28, 1991 | [JP] | Japan | 3-359521 |

[51] Int. Cl.[6] ..... H04R 3/00

[52] U.S. Cl. ..... 381/96; 381/59

[58] Field of Search ..... 381/96, 59

[56] References Cited

U.S. PATENT DOCUMENTS

| | | | |
|---|---|---|---|
| 3,798,374 | 3/1974 | Meyers | 179/1 F |
| 3,821,473 | 6/1974 | Mullins | 381/96 |
| 4,550,430 | 10/1985 | Meyers | 381/96 |
| 4,821,328 | 4/1989 | Drozdowski | 381/96 |
| 4,989,187 | 1/1991 | Yokoyama | 381/96 |
| 5,009,281 | 4/1991 | Yokoyama | 381/96 |
| 5,010,997 | 4/1991 | Furukawa | 381/96 |
| 5,033,577 | 7/1991 | Veranth | 181/156 |
| 5,092,424 | 3/1992 | Schreiber | 181/155 |
| 5,226,089 | 7/1993 | Yoon et al. | 381/59 |
| 5,327,504 | 7/1994 | Hobelsberger | 381/96 |

FOREIGN PATENT DOCUMENTS

| | | |
|---|---|---|
| 2625844 | 1/1988 | France . |
| 3625569 | 7/1986 | Germany . |
| 4021000 | 1/1992 | Germany . |
| 57-119597 | 7/1982 | Japan . |
| 59-090491 | 5/1984 | Japan . |
| 62-115994 | 5/1987 | Japan . |
| 62-206999 | 9/1987 | Japan . |
| 63-015125 | 1/1988 | Japan . |
| 2122051 | 1/1984 | United Kingdom . |

OTHER PUBLICATIONS

European Search Report dated Apr. 20, 1993 for EP Application 92121580.2.

Yoshii, Nippon Onkyo Society Lecture Theses, Acoustis Research Lab., Onkyo Corporation, pp. 281–282, Oct. 1978, "Extreme Low Frequency Sound Reproduction by a Passive Radiator and an Acoustis Transformer".

M. Colloms, High Performance Loudspeakers, 4th Ed., Pentech Press Lts., pp. 123–126, 1991, "4.5 Bandpass Enclosure Designs".

*Primary Examiner*—Forester W. Isen

*Attorney, Agent, or Firm*—Renner, Otto, Boisselle, Sklar

[57] ABSTRACT

A bass reproduction speaker apparatus of the present invention includes: a cabinet with an opening, having a division member inside thereof; a speaker unit disposed at the division member; a passive radiator disposed in the opening; an amplifier for driving the speaker unit; a detector for detecting a vibration of a moving system of the speaker unit; and a feedback circuit for feeding back an output signal from the detector to the amplifier.

23 Claims, 16 Drawing Sheets

BASS REPRODUCTION SPEAKER APPARATUS

This is a continuation of copending application Ser. No. 07/992,028 filed on Dec. 17, 1992.

BACKGROUND OF THE INVENTION

1. Field of the Invention

The present invention relates to a bass reproduction speaker apparatus (bass is generally referred to as an audio signal with a frequency of about 200 Hz or less) conducting a motional feedback (MFB). More particularly, the present invention relates to a speaker apparatus for reproducing an audio signal in a deep bass band and an ultra bass band.

2. Description of the Related Art

In recent years, it has been desired that very low frequency audio signals such as a deep bass signal, an ultra bass signal, and the like recorded in a magnetic tape, a disk-shaped data recording medium, etc. are reproduced from a music source or an audio visual (AV) source at a sufficient sound volume and quality in households. In general, bass includes deep bass and ultra bass. In a broad sense, an ultra low frequency is also included in bass. There is no special limit to a band of a bass, deep bass, ultra bass, and an ultra low frequency, and it is variously changed in people and countries. In the present specification, the following definitions are used: bass has a frequency in the range of about 80 to about 200 Hz or in the range of about 100 to 200 Hz; deep bass has a frequency in the range of about 40 to about 80 Hz or in the range of about 50 to about 100 Hz; ultra bass has a frequency in the range of about 20 to about 40 Hz or in the range of about 20 to about 50 Hz; and an ultra low frequency has a frequency of 20 Hz or less. There has been a demand for deep bass reproduction speaker apparatuses which can be combined with stereo reproduction apparatuses or AV reproduction apparatuses and which are capable of reproducing an audio signal, and particularly a voice signal, in a deep bass bend, an ultra bass band, and the like as audio or voice sound with a high sound pressure level, in spite of the relatively small sizes of such speaker apparatuses.

In view of the above, a bass reproduction speaker apparatus, which is obtained by combining a speaker component in which a woofer is provided in a small closed cabinet or a small bass reflex cabinet and an electrical circuit module such as an amplifier for driving the speaker component has generally been used.

It is desired that the speaker component be able to effectively reproduce audio signals with fidelity at frequencies as low as possible in spite of the small size of the speaker component. Moreover, it is desired that the speaker component have a sound pressure level-frequency characteristic in which an audio signal with high frequency is attenuated.

It is known that a band-pass speaker can relatively effectively reproduce an audio signal having a low frequency, in spite of its small size, and attenuate an audio signal with a high frequency, so that the band-pass speaker has a preferred characteristic for reproducing bass audio signals. For example, a band-pass speaker is described in H. Yoshii, "Extreme Low Frequency Sound Reproduction by a Passive Radiator and an Acoustic Transformer, Nippon Onkyo Society Lecture Theses, pp. 281–282 (October, 1978); and Colloms, *High Performance Loudspeakers,* 4th ed., Pentech Press Limited, pp. 123–126 (1991).

A typical cabinet for such a band-pass speaker is divided into two parts, i.e., a front cavity and a back cavity, by a cavity division member. On the side of the back cavity, a speaker unit is provided on the cavity division member and on the side of the front cavity, a passive radiator is provided in an opening of the cabinet. In most cases, a low-pass filter is provided in front of an amplifier for driving the band-pass speaker.

Operation of the conventional bass reproduction speaker apparatus will be described with reference to an equivalent electrical circuit of a band-pass speaker as shown in FIGS. 11 and 12. Here, the moving system of the speaker unit refers to all of the portions which move in synchronization with the vibration of the speaker unit. More specifically, it refers to a diaphragm and a voice coil.

In FIG. 11, $F_d$ denotes a driving force provided from a voice coil of a magnetic circuit of a speaker unit. The driving force $F_d$ is transmitted to a moving system; an inductor $M_d$ denotes an effective moving mass of the moving system of the speaker unit; a capacitor $C_d$ denotes compliance of suspensions (including a surround and an inner suspension); a resistor $R_{md}$ denotes a mechanical resistance of the moving system of the speaker unit; a resistor $R_{ed}$ denotes an electromagnetic damping resistance caused by a reverse eleotromotive force of the magnetic circuit of the speaker unit; a capacitor $C_B$ denotes compliance of the air in the back cavity which is converted in terms of an effective diaphragm area of the speaker unit; a resistor $R_B$ denotes a mechanical resistance of the air in the back cavity which is converted in terms of an effective diaphragm area of the speaker unit; a capacitor $C_F$ denotes compliance of the air in the front cavity which is converted in terms of an effective diaphragm area of the speaker unit; a resistor $R_F$ denotes a mechanical resistance of the air in the front cavity which is converted in terms of an effective diaphragm area of the speaker unit; an inductor $M_p$ denotes an effective moving mass of the moving system of the passive radiator; a resistor $R_p$ denotes a mechanical resistance of the moving system of the passive radiator; a capacitor $C_p$ denotes compliance of the suspensions (including the surround and the inner suspension) of the passive radiator; $S_d$ denotes an effective diaphragm area of the speaker unit; $S_p$ denotes an effective diaphragm area of the passive radiator; current $V_d$ denotes a velocity of the moving system of the speaker unit; and current $V_p$ denotes a velocity of the moving system of the passive radiator.

$C_B$ can be expressed by the following equation:

$$C_B = \frac{V_B}{\rho \times C^2 \times S_d^2}$$

where, $V_B$: volume of the back cavity ($m^3$)

$\rho$: air density ($Kg/m^3$)

C: sound velocity (m/sac)

$S_d$: effective diaphragm area of the speaker unit ($m^2$)

The term $V_B/(\rho \times C^2)$ is referred to herein as the acoustic compliance. The acoustic compliance of the air in the back cavity changes significantly under the condition of a constant volume of the back cavity when the effective diaphragm area $S_d$ of the speaker unit to be attached is changed.

$R_B$ can be expressed by the following equation:

$$R_B = R_{CB} \times k \times S_d^2$$

where, $R_{CB}$: acoustic mechanical resistance of the air in the back cavity.

k: is a constant

Accordingly, the mechanical resistance $R_B$ of the air in the back cavity also changes in accordance with the square of the effective diaphragm area $S_d^2$ of the speaker unit. That is, the acoustic compliance and mechanical resistance are converted to compliance and mechanical resistance which act on the diaphragm of the speaker unit.

In FIG. 12, (A) As a sound pressure level-frequency characteristic curve when a motional feedback is not used.

The band-pass speaker has three resonance frequencies. These frequencies are referred to as $f_1$, $f_r$, and $f_2$ in the order of increasing frequency. An impedance-frequency characteristic curve of the band-pass speaker is generally as shown in FIG. 17. The resonance frequency $f_1$ can be calculated by using a synthetic mass of $M_d$ and $M_p$, and a synthetic compliance of $C_d$, $C_B$, $C_F$, and $C_p$. At $f_1$, the phase of $V_d$ is almost the same as that of $V_p$. The antiresonant frequency $f_r$ can be calculated by using $M_p$ and a synthetic compliance of $C_p$ and $C_F$. At $f_r$, $V_d$ becomes minimum. The resonance frequency $f_2$ is calculated by using $M_d$ and a synthetic compliance of $C_B$ and $C_F$. At $f_2$, the phases of $V_d$ and $V_p$ are shifted by nearly 180°. When the frequency is smaller than $f_1$ or larger than $f_2$, a characteristic in which a sound pressure level is attenuated at about 12 dB/oct is obtained.

In general, the following relationships: $C_d>C_B$, $C_d>C_F$, and $C_p>C_B$, $C_p>C_F$ are obtained, i.e., since stiffness (the reciprocal of compliance) of the air in the cabinet is larger than that of the edge and damper of the speaker unit or that of the passive radiator. $C_B$ and $C_F$ are dominant in the resonance frequency, and $C_d$ and $C_p$ can generally be ignored (the resonance frequency is changed a great amount due to the change of the values of $C_B$ and $C_F$, and the resonance frequency is not changed a great amount due to the change of the values of $C_d$ and $C_p$). In addition, $f_1$ is changed in a great amount due to the value of $M_p$ rather than that of $M_d$. Thus, $f_1$ is determined by $M_p$ and a synthetic compliance of $C_B$ and $C_F$; and $f_r$ is determined by $M_p$ and $C_F$.

A resonance Q value (relating to the sharpness of resonance) is determined by the magnitude of $R_{md}$, $R_B$, $R_F$, $R_p$, and $R_{ed}$. In general, since the following relationships: $R_{ed}>R_{md}$, $R_{ed}>R_B$, $R_{ed}>R_F$, and $R_{ed}>R_p$ are obtained, the resonance Q is greatly changed by $R_{ed}$. Thus, in order to obtain a sound pressure level-frequency characteristic curve having a plateau between $f_1$ and $f_2$, the following is conducted. $M_d$, $M_p$, $C_B$, and $C_F$ are set at appropriate values so that the height of each resonance peak $f_1$ and $f_2$ is aligned, and $R_{ed}$ is made sufficiently large so as to lower each resonance peak. Accordingly, a sound pressure level-frequency characteristic curve having a plateau between $f_1$ and $f_2$ is obtained. Here, the frequency distance between $f_1$ and $f_2$ is at most 1.5 to 2 octaves, and if the distance exceeds this value, a characteristic curve having a concave shape between $f_1$ end $f_2$ is obtained.

The resonance Q is in proportion to mass/(compliance× resistance), so that as $M_d$ and/or $M_p$ increase and as $C_B$ and/or $C_F$ lower, the resonance Q becomes higher and a greater value of $R_{ed}$ is required. In the case where $R_{ed}$ is not large enough, a sound pressure level-frequency characteristic curve (A) having peaks at $f_1$ and $f_2$ as shown in FIG. 12 is obtained. $R_{ed}$ operates as an electromagnetic caused by a reverse electromotive force of the voice coil generated when the moving system of the speaker unit vibrates. Since $R_{ed}$=(magnetic flux density of the magnetic circuit×effective conductor length of the voice coil)$^2$/DC resistance of the voice coil, $R_{ed}$ is generally larger in a speaker unit which has a strong magnetic circuit due to a large magnet.

In order to shift a reproduction frequency band toward an ultra bass band, it is required to lower $f_1$ and $f_2$, in particular, $f_1$ by increasing $M_p$, $M_d$, $C_B$, and $C_F$. When $M_p$ is increased, the sound pressure level is likely to be totally lowered; however, this does not cause a significant problem since an amplifier with a high power level can easily be realized in recent years. Here, when $M_d$ and $M_p$ alone are increased, the resonance Q becomes higher and peaks are formed in the sound pressure level-frequency characteristic curve, so that it is also required to increase $C_B$ and $C_F$.

The band-pass speaker uses resonance and has a band-pass characteristic, so that the speaker has relatively high efficiency and is suitable for reproducing a bass. This speaker is driven by an amplifier, whereby a bass reproduction speaker apparatus which reproduces a deep bass is constituted. When the frequency is several hundreds of Hz or more, the characteristic is deteriorated because a standing wave is superimposed on a normal voice signal wave to be reproduced in the cabinet. Thus, in most cases, a low-pass filter is provided to attenuate a signal with a high frequency.

As is described above, in order to shift the reproduction frequency band toward the ultra bass band, it is required to increase $M_d$, $M_p$, $C_B$, $C_F$, and $R_{ed}$. However, there is a limit to the increase in $R_{ed}$ in view of a size of a magnet of a magnetic circuit and a resultant cost. In addition, since the resonance Q is in proportion to mass/(compliance×resistance), it is required to increase $C_B$ and $C_F$ rather than $M_d$ and $M_p$ so as not to cause a resonance peak in the sound pressure level-frequency characteristic curve. $C_F$ is a volume of the front cavity/(air density×air sound velocity$^2$× (effective diaphragm area of the speaker unit $S_d^2$)). In view of the desire for miniaturization of the bass reproduction speaker apparatus, it is not desired that the cabinet volume be increased so as to increase $C_B$ and $C_F$. In order to increase $C_B$ and $C_F$ without increasing the cabinet volume, there is no choice but to lower the effective diaphragm area $S_d$ of the speaker unit.

More specifically, in the above-mentioned conventional structure, there is a limit to the increase in $R_{ed}$, so that for the purpose of reproducing the ultra bass, there is no choice but to lower the effective diaphragm area $S_d$ of the speaker unit so as not to cause a resonance peak in the sound pressure level-frequency characteristic curve. That is, a diameter of the speaker unit has to be lowered. As a result, the maximum air volume which a diaphragm of the speaker unit can oscillate is lowered and the maximum output sound pressure level of an ultra bass is lowered. Therefore, it can be said that the capability of the speaker unit comes to its limit before the power of the amplifier does.

Accordingly, in the conventional structure, when an ultra bass signal is reproduced with a constant frequency by using a small cabinet, the diameter of the speaker unit has to be lowered. Thus, there are the following problems even though an amplifier with a large output level is easily realized in recent years. A high maximum output sound pressure level cannot be obtained; and it is difficult to realize a speaker unit which can reproduce a bass in spite of its small size, since the magnetic circuit of the speaker unit should be made extremely large.

Moreover, when the effective diaphragm area of the speaker unit is forced to be increased in order to increase the maximum output sound pressure level, $C_B$ and $C_F$ are lowered and it is required to increase $M_d$ and $M_p$ so as not to increase the resonance frequency. As a result, the resonance Q at the above-mentioned two resonance frequencies $f_1$ and $f_2$ becomes very high, and high peaks cannot be damped even though $R_{ed}$ is slightly increased. Thus, a sound pressure level-frequency characteristic curve having a plateau cannot be obtained.

SUMMARY OF THE INVENTION

The bass reproduction speaker apparatus according to one aspect of the present invention includes: a cabinet with an opening, having a division member inside thereof; a speaker unit disposed at the division member; a passive radiator disposed in the opening; an amplifier for driving the speaker unit; a detector for detecting a vibration of a moving system of the speaker unit; and a feedback circuit for feeding back an output signal from the detector to the amplifier.

According to another aspect of the present invention, the bass reproduction speaker apparatus includes: a cabinet with an opening, having a division member inside thereof; a speaker unit disposed at the division member; a second speaker unit disposed in the opening; an amplifier for driving the speaker unit; a detector for detecting a vibration of a moving system of the speaker unit; a feedback circuit for feeding back an output signal from the detector to the amplifier; a second detector for detecting a vibration of a moving system of the second speaker unit; and a second feedback circuit for feeding back an output signal from the second detector to the amplifier.

According to still another aspect of the present invention, the bass reproduction speaker apparatus includes: a cabinet which has openings on respective sides thereof, facing each other and has a division member inside thereof; a speaker unit disposed at the division member; passive radiators provided in the respective openings; an amplifier for driving the speaker unit; a detector for detecting a vibration of a moving system of the speaker unit; and a feedback circuit for feeding back an output signal from the detector to the amplifier.

According to still another aspect of the present invention, the bass reproduction speaker apparatus includes: a cabinet with an opening, having a division member inside thereof; a speaker unit disposed at the division member; a port provided in the opening; an amplifier for driving the speaker unit; a detector for detecting a vibration of a moving system of the speaker unit; and a feedback circuit for feeding back an output signal from the detector to the amplifier.

According to the structure of the present invention, a signal from a driving circuit which conducts a velocity-type MFB is input into the speaker unit to conduct the velocity-type MFB, whereby the electromagnetic damping resistance of the speaker unit can equivalently be increased in a great amount. In the case where the electromagnetic damping resistance is large, even though the effective diaphragm area of the speaker unit is set at a large value and the resonance frequencies $f_1$ and $f_2$ are lowered, the peaks in the sound pressure level-frequency characteristic curve can be made lower than that of the conventional case. Thus, a signal can be output at a high maximum output sound pressure level.

There are various examples in the present invention, which will be described below, and in each example the above-mentioned objective and effects are the same.

Thus, the invention described herein makes possible the advantage of providing a small-sized bass reproduction speaker apparatus for reproducing a signal over a wide range of ultra bass at a substantially almost constant high maximum output sound pressure level.

This and other advantages of the present invention will become apparent to those skilled in the art upon reading and understanding the following detailed description with reference to the accompanying figures.

DESCRIPTION OF THE PREFERRED EMBODIMENTS

Figure 1:
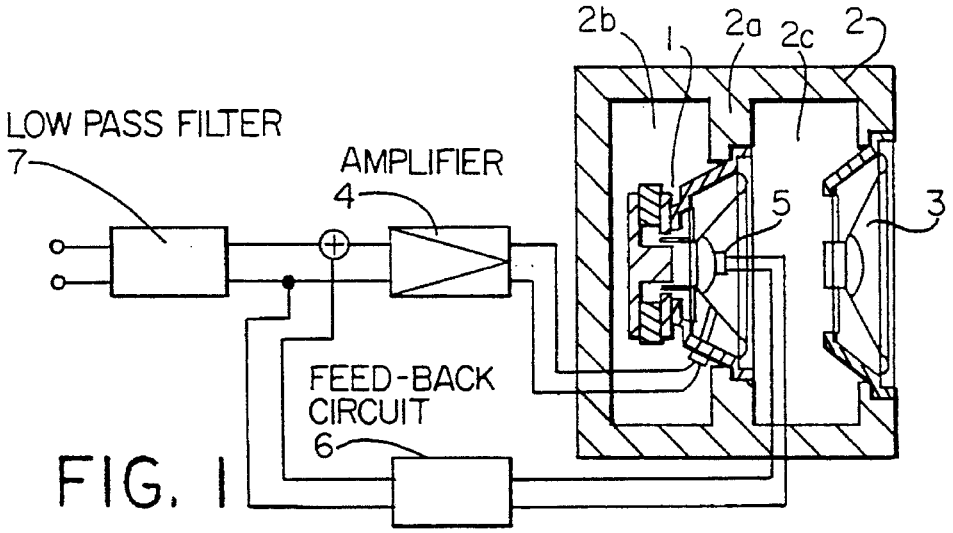
FIG. 1 is a block diagram showing a bass reproduction speaker apparatus in a first example of the present invention.

Initially, the principle of a motional feedback (MFB) will briefly be described. According to the MFB, the vibration of a moving system of a speaker unit is detected and a detection signal is fed back to an input of an amplifier, whereby the vibration of the moving system can be regulated. The MFB is based on the principle of an operation of a system conducting a negative feedback according to an automatic control theory. According to the negative feedback in an amplifier circuit, the output voltage from the amplifier is negatively fed back to the input of the amplifier, whereby the amplifier operates so as to make an output voltage-frequency characteristic curve constant over a wide range of frequency. The principle and effects of negative feedback in the amplifier circuit are well known.

In the MFB system, a signal which is negatively fed back is different from that in the case of the amplifier circuit. In the MFB system, a voltage which is in proportion to the velocity of the moving system of the speaker unit is negatively fed back to the input of the amplifier (referred to a velocity-type MFB). The amplifier in the MFB system operates so as to make a signal output level almost or substantially constant in a wide range of frequency. As a result, a velocity-frequency characteristic curve of the moving system becomes flat in a wide range. In the case where a voltage which is in proportion to an acceleration of the moving system of the speaker unit is negatively fed back to the input of the amplifier in the MFB system (referred to as an acceleration-type MFB), the amplifier of this MFB system operates so as to make a signal output level almost or substantially constant in a wide range of frequency. As a result, an acceleration-frequency frequency characteristic curve of the moving system becomes flat over a wide range.

In the case where a voltage which is in proportion to a displacement of the moving system of the speaker unit is negatively fed back to the input of the amplifier in MFB system (referred to as a displacement-type MFB), the amplifier of this MFB system operates so as to make a signal output level almost or substantially constant over a wide range of frequency. As a result, a displacement-frequency characteristic curve of the moving system becomes flat across a wide range.

For the purpose of detecting the vibration of the moving system of the speaker unit, a sensor is generally attached to a diaphragm. When the frequency is increased, the diaphragm does not oscillate uniformly. Because of this, the phase of the detection signal is rotated, so that a stable feedback is not conducted. Thus, in general, the MFB is conducted in a band of medium-pitched or lower-pitched frequencies. These three kinds of MFBs are appropriately conducted in combination so as to obtain a desired frequency characteristic.

As described above, MFB is a useful technique; however, if the MFB is conducted at random, an excellent frequency characteristic cannot be obtained and there is a great danger of causing a vibration which can destroy a device. In general, an exact calculation of a frequency characteristic and an analysis thereof are performed by using a computer simulation.

In the past, the MFBs have been conducted only in closed speakers or sometimes in bass reflex speakers. It can be considered to conduct the MFB in speakers of other systems; however, if an exact calculation of the frequency characteristic and an analysis thereof by using a computer simulation are not involved, this application is just expectation and cannot be realized.

Figure 26:
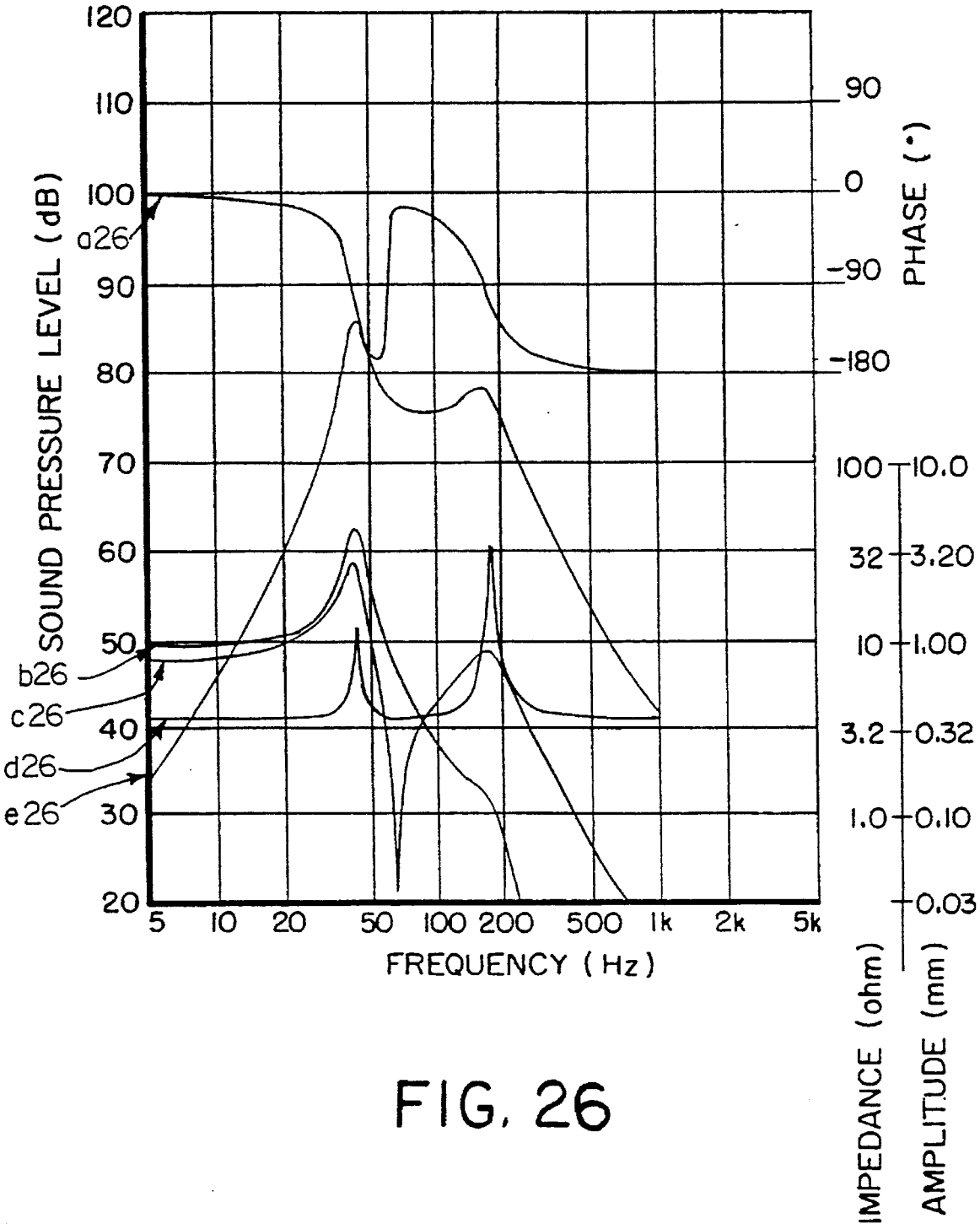
FIG. 26 is a computer simulation diagram of a sound pressure level-frequency characteristic curve of the band-pass speaker in the first example of the present invention, in the case where the MFB is not conducted.
Figure 27:
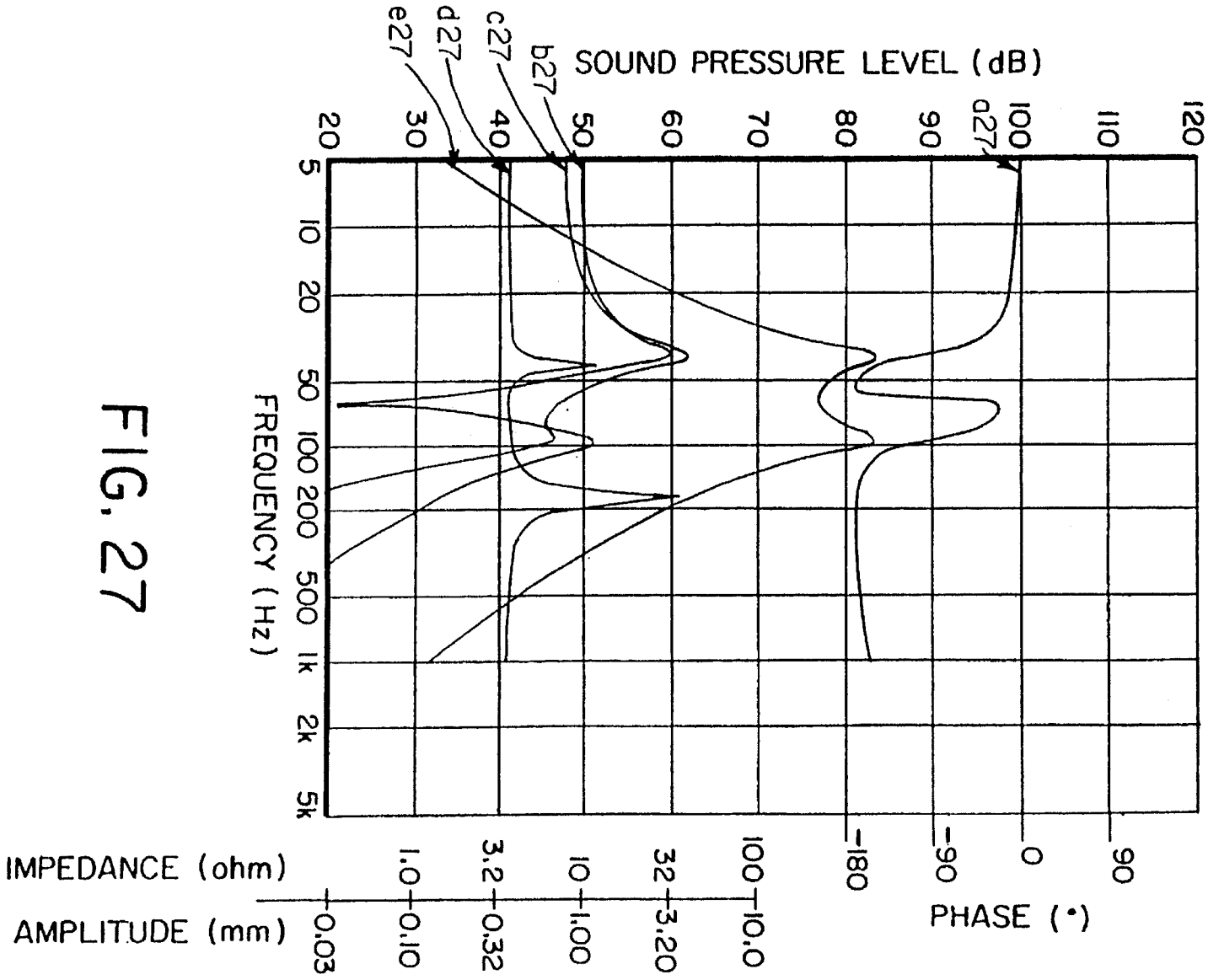
FIG. 27 is a computer simulation diagram of a sound pressure level-frequency characteristic curve of the band-pass speaker in the first example of the present invention, in the case where the acceleration-type MFB is conducted.
Figure 28:
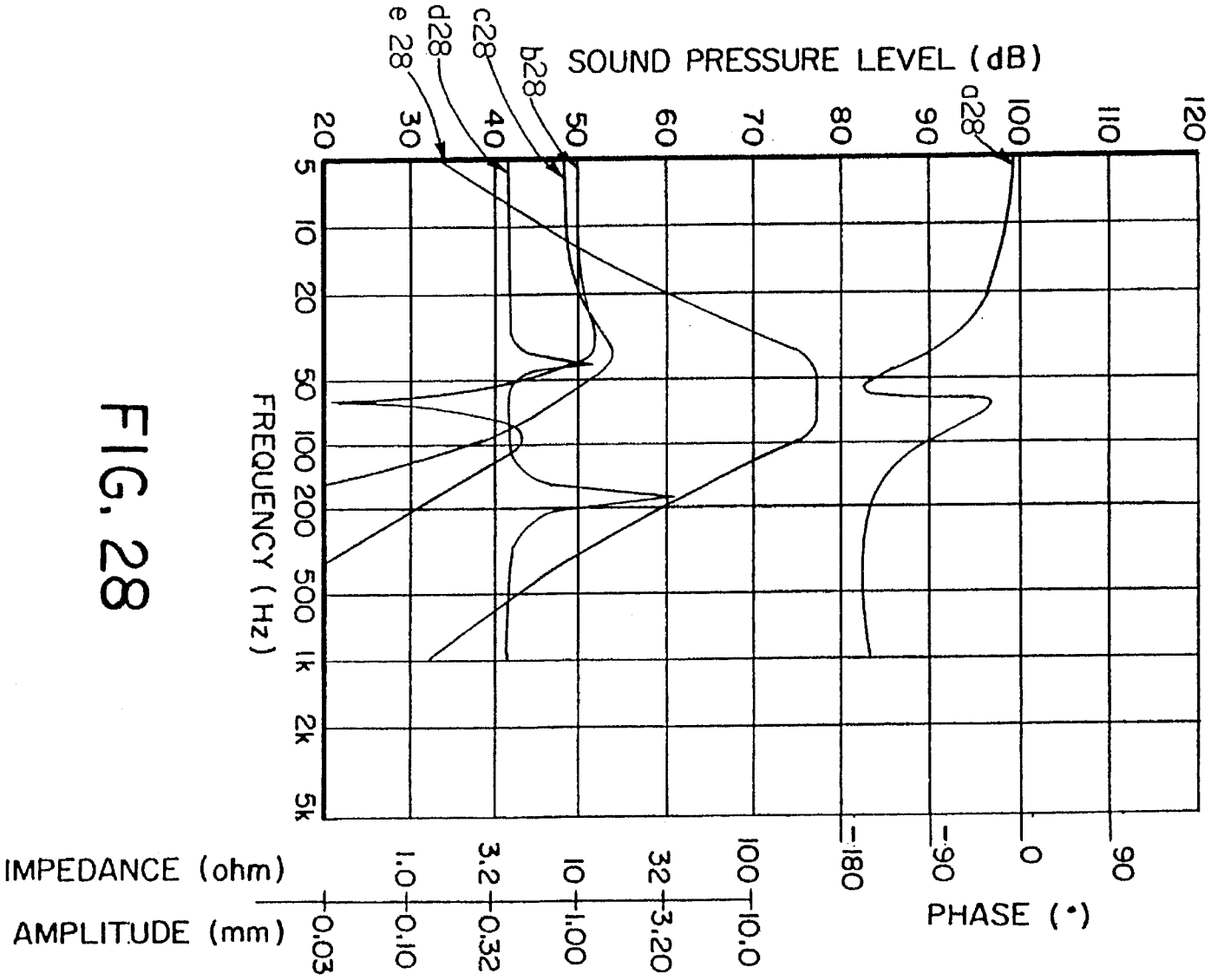
FIG. 28 is a computer simulation diagram of a sound pressure level-frequency characteristic curve of the band-pass speaker in the first example of the present invention, in the case where the acceleration type MFB and the velocity-type MFB are conducted.

We succeeded in the development of a computer simulation program of the MFB in a band-pass speaker. Examples as a result of this development are shown in FIGS. 26 to 28. In FIGS. 26 to 28; a26, a27, and a28 are phase-frequency characteristic curves of amplitude of the diaphragm of the speaker unit; b26, b27, and b28 are amplitude of the diaphragm of the speaker unit-frequency characteristic curves; c26, c27, and c28 are amplitude of the diaphragm of the passive radiator-frequency characteristic curves; d26, d27, and d28 are impedance-characteristic curves; and e26, e27, and e28 are sound pressure level-frequency characteristic curves. Because of this development of the computer simulation, the operation and effects of the MFB in the band-pass speaker are made clear, an exact calculation of a frequency characteristic and an analysis thereof become possible, and the application of the MFB to the band-pass speaker has been made possible for the first time. For example, it was found from the developed simulation that the velocity-type MFB is particularly important in the case of the band-pass speaker.

Hereinafter, the effects of the MFB in the band-pass speaker will be described with reference to FIGS. 11 to 14. In FIG. 12, (B) is a velocity-frequency characteristic curve of the moving system of the speaker unit when MFB is not conducted. (C) is a sound pressure level-frequency characteristic curve when the velocity-type MFB is conducted in accordance with the present invention. (D) is a velocity-frequency characteristic curve of the moving system of the speaker unit when velocity-type MFB is conducted in accordance with the present invention. (E) is an acceleration-frequency characteristic curve of the moving system of the speaker unit when MFB is not conducted.

Figure 14:
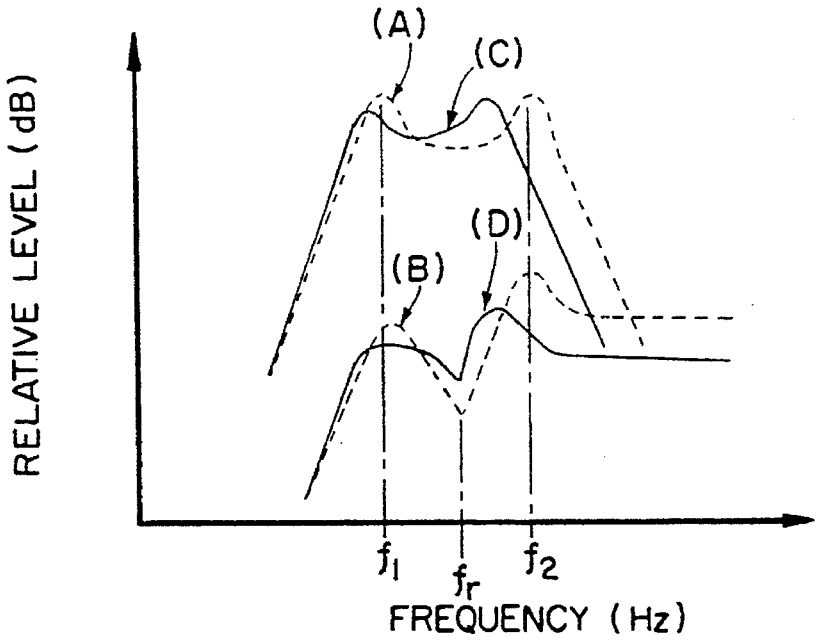
FIG. 14 is a relative level-frequency characteristic curve illustrating effects of the acceleration-type MFB in the examples of the present invention.

In FIGS. 12 and 14, a level (in decibels) of each signal is shown in relation to a vertical axis. A vertical axis of the curves (A) and (C) denotes a sound pressure level (SPL). The sound pressure level (SPL) is expressed by the following equation:

$$SPL = 20\log_{10}\frac{P}{2\times 10^{-5}}\ \text{(dB)}$$

where, P is a sound pressure.

A velocity of the moving system is expressed in terms of a log scale. That is, suppose the velocity of the moving system is V (m/s), a vertical axis of the curves (B) and (D) denotes a velocity level of the moving system (Ve).

$$Ve = 20\log_{10}\frac{V}{V_0}\ \text{(dB)}.$$

($V_0$ is appropriately determined so that a characteristic curve is positioned in the middle of the graph).

A velocity of the moving system is expressed in terms of a log scale. That is, suppose the acceleration of the moving system is $\alpha(m/s^2)$, a vertical axis of the curve (E) denotes an acceleration level of the moving system (Ae).

$$Ae = 20\log_{10}\frac{\alpha}{\alpha_0}\ \text{(dB)}$$

($\alpha_0$ is also appropriately determined so that a characteristic curve is positioned is the middle of the graph).

Figure 11:
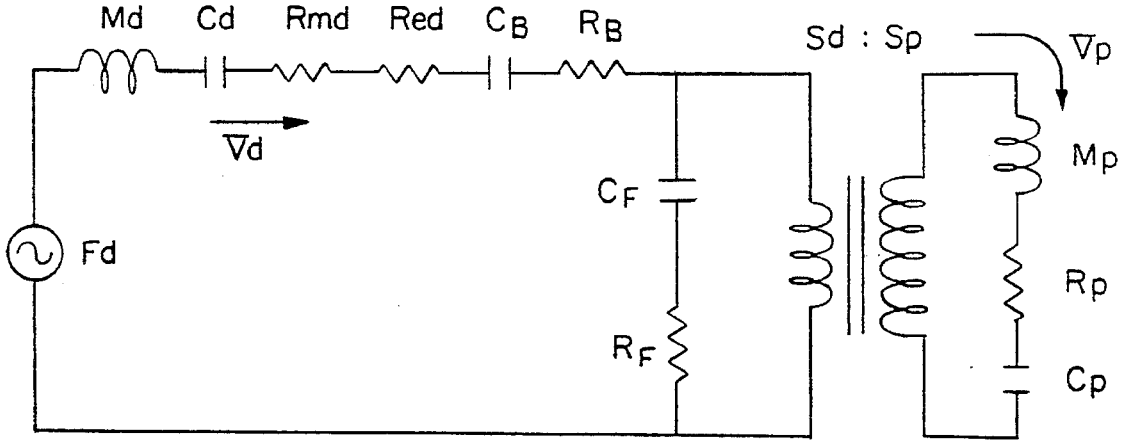
FIG. 11 is an electrical equivalent circuit diagram of a band-pass speaker.
Figure 12:
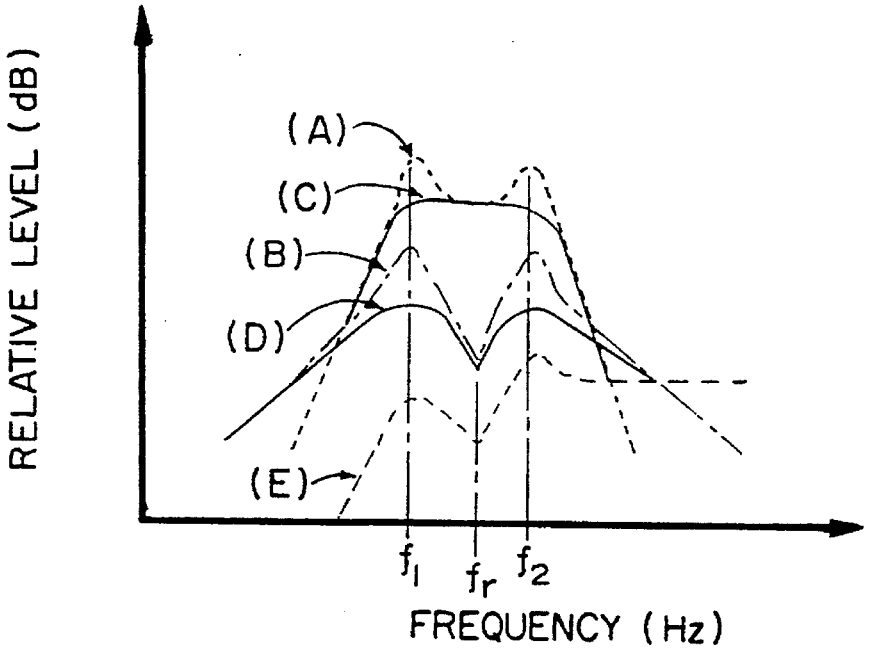
FIG. 12 is a relative level-frequency characteristic curve illustrating effects of a velocity-type MFB in the examples of the present invention.

The velocity of the moving system of the speaker unit is represented by $V_d$ in the electrical acoustic equivalent circuit in FIG. 11. When frequency is very low, $V_d$ is greatly changed due to a change in value of a reactance component (compliance of the air in the back cavity $C_B$) in the equivalent circuit. For example, when the frequency is reduced by one-half, $V_d$ is reduced by one-half. Thus, the velocity level is attenuated at the rate of 6 dB/oct. In contrast, when the frequency is very high, $V_d$ is greatly changed due to a change in value of a reactance component (effective moving mass of the speaker unit $M_d$) in the equivalent circuit. For example, when the frequency becomes twice, $V_d$ becomes ½ times. In this case, the velocity level is also attenuated at 6 dB/oct. In the case where a sound pressure level-frequency characteristic curve has peaks in the vicinity of $f_1$ and $f_2$, $V_d$ also has peaks in the vicinity of $f_1$ and $f_2$, and becomes minimum at an antiresonant frequency $f_r$. More specifically, when the sound pressure level-frequency characteristic curve of the passive radiator becomes a characteristic curve (A) in FIG. 12, the velocity-frequency characteristic curve of the moving system of the speaker unit becomes as shown in (B) of FIG. 12.

Here, the velocity of the moving system of the speaker unit is detected in the above-mentioned structure to conduct the velocity-type MFB; i.e., a voltage which is in proportion to the velocity of the moving system of the speaker unit is negatively fed back to the amplifier, whereby the amplifier operates so as to make a velocity-frequency characteristic curve of the moving system of the speaker unit almost constant in a wide range. Thus, the peaks at $f_1$ and $f_2$ in the velocity-frequency characteristic curve of the moving system of the speaker unit become blunt as shown in (D) of FIG. 12. In accordance with this, the sound pressure level-frequency characteristic curve of the passive radiator has a plateau between $f_1$ and $f_2$ as shown in (C) of FIG. 12. To conduct the velocity-type MFB in this way is equivalent to the case where $R_{ed}$ of the speaker unit of the electrical acoustic equivalent circuit in FIG. 11 is increased, and corresponds to the case where the magnetic circuit of the speaker unit is made strong. The increase in the feedback amount in the velocity-type MFB is equivalent to the case where $R_{ed}$ is increased in a great amount, so that the velocity-type MFB is very useful in the band-pass speaker in which peaks are likely to occur at $f_1$ and $f_2$ in the characteristic curve.

The acceleration is obtained by differentiating the velocity with radian frequency. An acceleration-frequency characteristic curve of the moving system is obtained by raising the whole characteristic curve (B) in FIG. 12 by 6 dB/oct in the upper right direction. That is, the acceleration-frequency characteristic curve of the moving system is flat at $f_2$ or more and the acceleration level is attenuated at 12 dB/oct at $f_1$ or less (see (E) in FIG. 12 and (A) in FIG. 14). In FIG. 14, (A) is a sound pressure level-frequency characteristic curve when the MFB is not conducted; (B) is a velocity-frequency characteristic curve of the moving system of the speaker unit when the MFB is not conducted; (C) is a sound pressure level-frequency characteristic curve when the acceleration-type MFB is conducted; and (D) is a velocity-frequency characteristic curve of the moving system of the speaker unit when the MFB is conducted.

When the acceleration type MFB is conducted, the amplifier operates so as to make the acceleration-frequency characteristic curve of the moving system of the speaker unit almost constant in a wide range of frequency, so that the characteristic curve (B) in FIG. 14 becomes that of (D) in FIG. 14. To conduct the acceleration-type MFB is equivalent to the case where the effective moving mass $M_d$ of the speaker unit of the electrical acoustic equivalent circuit in FIG. 11 is increased, and corresponds to the case where the moving system of the speaker unit is made heavier by mass. The increase in the feedback amount in the acceleration-type MFB is equivalent to the case where the effective moving mass $M_d$ of the speaker unit is increased in a great amount. In accordance with this, the balance of the resonance Q at $f_1$ and $f_2$ in the sound pressure level-frequency characteristic curve of the passive radiator is changed, and the height of the peak is slightly increased along with the lower in $f_2$ and the height of the peak at $f_1$ is slightly lowered. That is, the sound pressure level-frequency characteristic curve (A) of the passive radiator in FIG. 14 becomes that as shown in (C) of FIG. 14, when the acceleration type MFB is conducted.

As described above, to conduct the velocity-type MFB and the acceleration-type MFB together is equivalent to the case where the electromagnetic damping resistance and the effective moving mass of the speaker unit can be increased in a great amount.

Figure 13:
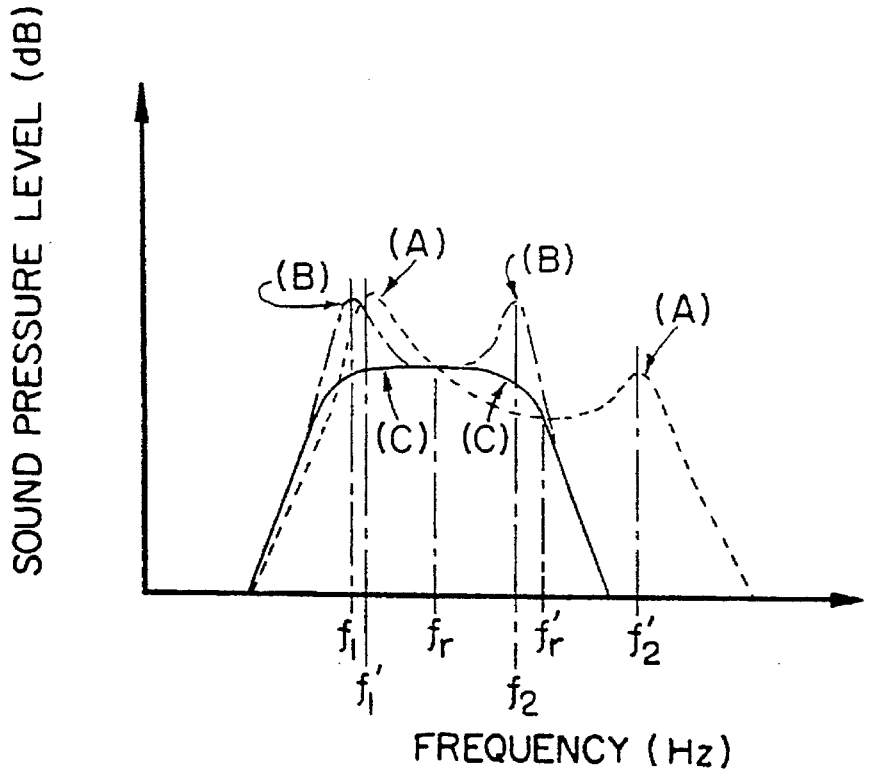
FIG. 13 is a sound pressure level-frequency characteristic curve illustrating effects in the case where the velocity-type MFB and an acceleration-type MFB are conducted together in the examples of the present invention.

Hereinafter, it will be described with reference to FIG. 13 that a sound pressure level-frequency characteristic curve with a plateau in an ultra bass band can be obtained by conducting the velocity-type MFB and the acceleration-type MFB together, even when the effective diaphragm area of the speaker unit is large. When the MFB is not conducted, the resonance frequencies of a sound pressure level-frequency characteristic curve are $f'_1$, $f'_r$, and $f'_2$, When the MFB is conducted, the resonance frequencies of a sound pressure level-frequency characteristic curve are $f_1$, $f_r$, and $f_2$. The resonance frequencies $f_1$ and $f_2$ are respective peaks at a sound pressure level-frequency characteristic curve; $f_r$ is positioned in the middle between the peaks of $f_1$ and $f_2$, if the heights of the peaks are almost the same; and $f_r$ is positioned in a concave portion of a sound pressure level-frequency characteristic curve, if the heights of the peaks $f_1$ and $f_2$ are different. In FIG. 13, (A) shows a sound pressure level-frequency characteristic curve without the MFB when $M_p$ is increased to lower $f_1$, in the case where the effective diaphragm area $S_d$ of the speaker unit is large. As shown in FIG. 13, since the effective diaphragm area $S_d$ of the speaker unit is large, a sound pressure level-frequency characteristic curve in which $f_2$ is high, the distance between $f_1$ and $f_2$ is widened, and a concave shape is formed between $f_1$ and $f_2$.

In FIG. 13, (B) shows a velocity-frequency characteristic curve when $M_p$ is increased and the acceleration-type MFB is conducted. When $f_1$ alone is lowered, the distance between $f_1$ and $f_2$ is widened too much and it becomes difficult to obtain a sound pressure level-frequency characteristic curve with a plateau, so that it is required to lower $f_2$. When the acceleration-type MFB is conducted as described above, $f_2$ is lowered. The acceleration type MFB is conducted so as to lower $f_2$ and align the heights of peaks at $f_1$ and $f_2$. In this case, the velocity-frequency characteristic curve (B) in FIG. 13 is obtained.

In addition to this, when velocity-type MFB is further conducted, the electromagnetic damping resistance of the speaker unit can equivalently increased in a great amount as described above, whereby the peaks at $f_1$ and $f_2$ can be suppressed. As a result, a sound pressure level-frequency characteristic curve (C) in FIG. 13 in which a sound pressure level is almost or substantially constant over a wide range of ultra-low frequencies is obtained.

If the effective moving mass of the speaker unit is actually increased by adding a weight to the diaphragm of the speaker unit, it is not required to conduct the acceleration-type MFB. Thus, the acceleration-type MFB is not always required. Here, if a very heavy weight is added to the diaphragm, there is a possibility that an excess load will be applied to the suspensions of the speaker unit as a result to cause the rocking motion of the diaphragm. Thus, the acceleration-type MFB is effective for the purpose of avoiding these problems. Moreover, the acceleration-type MFB is effective because the cumbersome work of adding (or removing) the weight can be saved.

As described above, according to the present invention, the peaks can be suppressed while the resonance frequencies $f_1$ and $f_2$ are lowered under the condition that the effective diaphragm area of the speaker unit is large. Moreover, a sound signal can be output at a high maximum output sound pressure level and with a constant sound pressure level across a wide range of deep bass and ultra bass signals in spite of the small size.

Hereinafter, the present invention will be described by way of illustrating examples with reference to the drawings. The examples illustrate the present invention and are not intended to limit the scope of the present invention.

EXAMPLES

Example 1

A first example of the present invention will be described with reference to FIGS. 1, 18, 19, 24, 26, 27, and 28. In FIG. 1, a speaker unit 1 has a diameter of 18 centimeters (cm), an effective vibration radius of 71.3 millimeters (mm), an effective moving mass of 25 g, a magnet size of a magnetic circuit of ø90 mm×ø40 mm×15 mm (the mark ø refers to an inside diameter or an outside diameter), a diameter of a voice coil of ø32 mm, a magnetic flux density of the magnetic circuit of 0.95 tesla, an effective conductor length of the voice coil of 7.37 m, a DC resistance of the voice coil of 3.7Ω, a max linear excursion of ±5 mm, and a lowest resonance frequency of 32 Hz. A diaphragm is provided with a voice coil. The maximum amplitude of the diaphragm is also a maximum amplitude of the voice coil. The speaker unit 1 is attached to a cavity division member 2*a*. A passive radiator 3 has a diameter of 20 cm, an effective vibration radius of 75 mm, and an effective moving mass of 140 g, and is capable of outputting a signal with a great amplitude at a lowest resonance frequency of 20 Hz. The passive radiator 3 is attached to an opening of a cabinet 2. A back cavity 2*b* and a front cavity 2*c* have an internal volume of 2.75 liters and 2.1 liters, respectively. An outside dimension of the cabinet 2 is 225 mm×225 mm×176 mm (height×width×depth). The speaker unit 1 is driven by an amplifier 4 with an output power of 100 W and an input voltage sensitivity of 1 V. The input voltage sensitivity of the amplifier refers to an input voltage at the time when the maximum output is generated. A low-pass filter 7 with a cutoff frequency of 500 Hz is disposed in front of the amplifier 4, whereby signals at higher frequencies are sufficiently attenuated. In addition, a sensor 5 for detecting the vibration of a moving system is provided at the center of a diaphragm of a speaker unit 1. A detection signal from the sensor 5 is fed back to the amplifier 4 by a feedback circuit 6, and a velocity-type MFB or an acceleration-type MFB is conducted. In the present example, as the sensor 5, a piezoelectric sensor is used, so that the detection signal thereof is a voltage which is in proportion to an acceleration of the moving system of the speaker unit 1.

Figure 24:
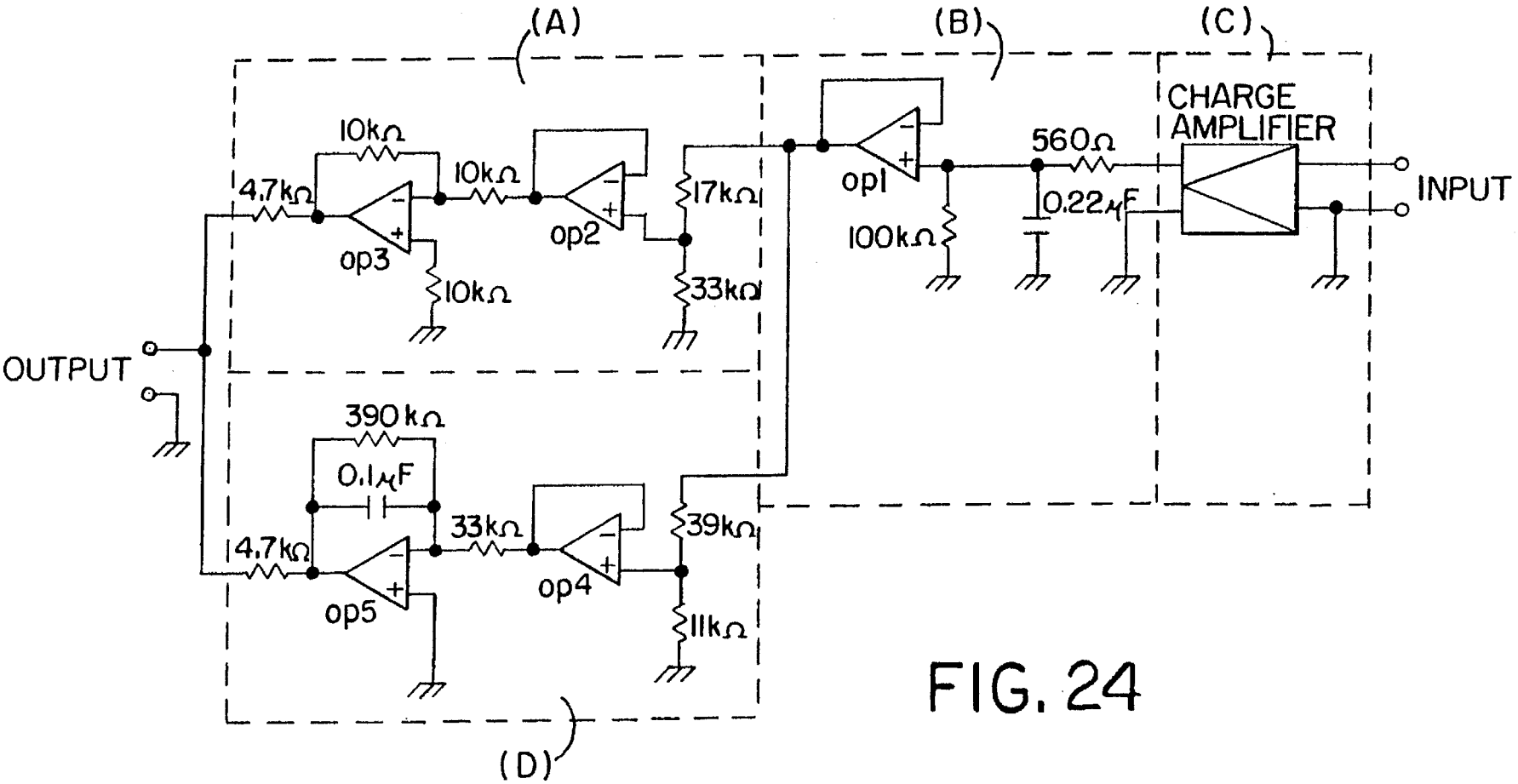
FIG. 24 is a diagram of a feedback circuit in the first example of the present invention.

In FIG. 24, a diagram of the feedback circuit 6 is shown. In FIG. 24, (A) is a gain-control circuit section for the acceleration-type MFB; (B) is a low-pass filter section; (C) is a preamplifier section; and (D) is an integrating circuit and a gain-control circuit section for the velocity-type MFB. In the case where the acceleration-type MFB is conducted in the feedback circuit 6, the level of the detection signal from the sensor 5 is determined by controlling the gain thereof in the feedback circuit 6 so that the effective moving mass of the speaker unit 1 equivalently becomes 105 g. Moreover, in the case where the velocity-type MFB is conducted in the feedback circuit 6, the level of the detection signal from the sensor 5 is determined by controlling the gain thereof in the feedback circuit 6 so that the electromagnetic damping resistance of the speaker unit 1 equivalently becomes 45.7 g.Ω. In the case of the velocity-type MFB, the detection signal from the sensor 5 is converted to a voltage which is in proportion to the velocity of the moving system by being passed through the integrating circuit. When a signal with a high frequency is fed back by the MFB, the output signal from the amplifier becomes unstable, so the feedback signal is attenuated in a high frequency band by providing the low-pass filter with a cutoff frequency of 1.2 kHz in the feedback circuit 6.

Since the speaker unit 1 has an electromagnetic damping resistance of 13.2 g.Ω, the case in which this resistance is increased to 45.7 g.Ω corresponds to the case in which the magnetic flux density of the magnetic circuit is increased by a factor of 1.86. Thus, it is quite difficult and expensive to increase the value of the electromagnetic damping resistance by using the magnetic circuit alone without the velocity-type MFB.

The curve e26 in FIG. 26 shows a computer simulation of a sound pressure level-frequency characteristic curve in the case where the MFB is not conducted. It is understood from this simulation that large peaks occur in the vicinity of 45 Hz and 180 Hz, and there is a concave shape between 45 Hz and 180 Hz. Thus, this characteristic is not useful. The curve e27 in FIG. 27 shows a computer simulation of a sound pressure level-frequency characteristic curve in the case where the acceleration-type MFB, which makes the effective moving mass of the speaker unit 1 equivalently 105 g, is conducted. It is understood from this simulation that the heights of two peaks are substantially aligned. The curve e28 in FIG. 28 shows a computer simulation of a sound pressure level-frequency characteristic curve in the case where the velocity-type MFB, which makes the electromagnetic resistance of the speaker unit 1 equivalently 45.7 g.Ω, is conducted. It is understood from this simulation that a sound pressure level-frequency characteristic curve having a plateau between about 40 Hz and about 100 Hz is obtained.

Figure 18:
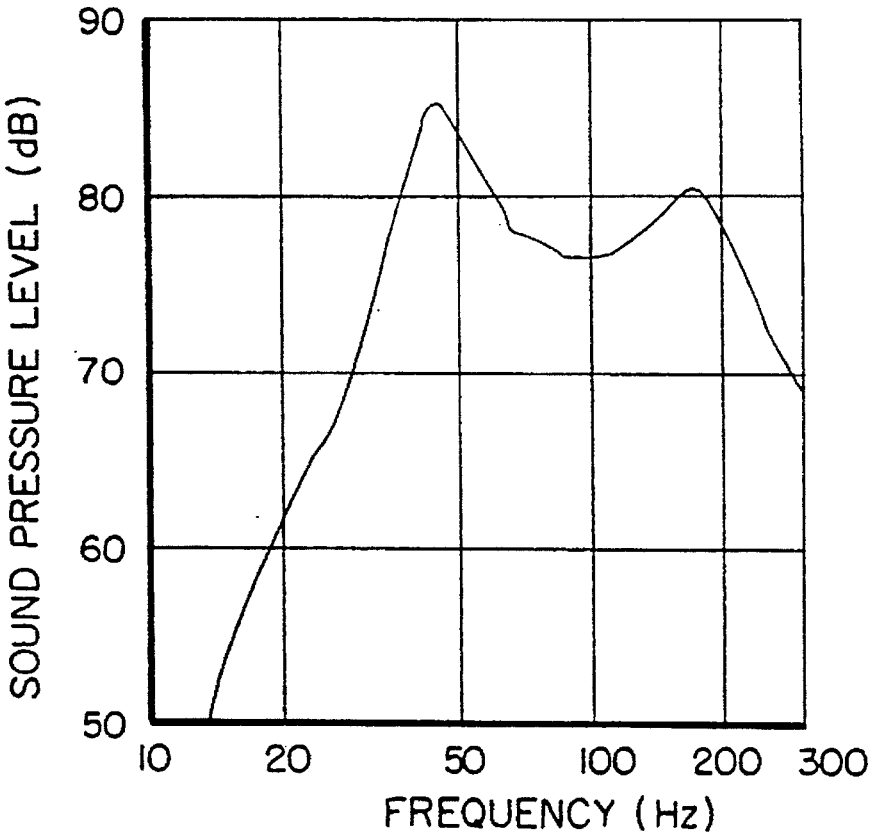
FIG. 18 is an actual measured sound pressure level-frequency characteristic curve of the bass reproduction speaker apparatus in the first example of the present invention, in the case where the MFB is not conducted.
Figure 19:
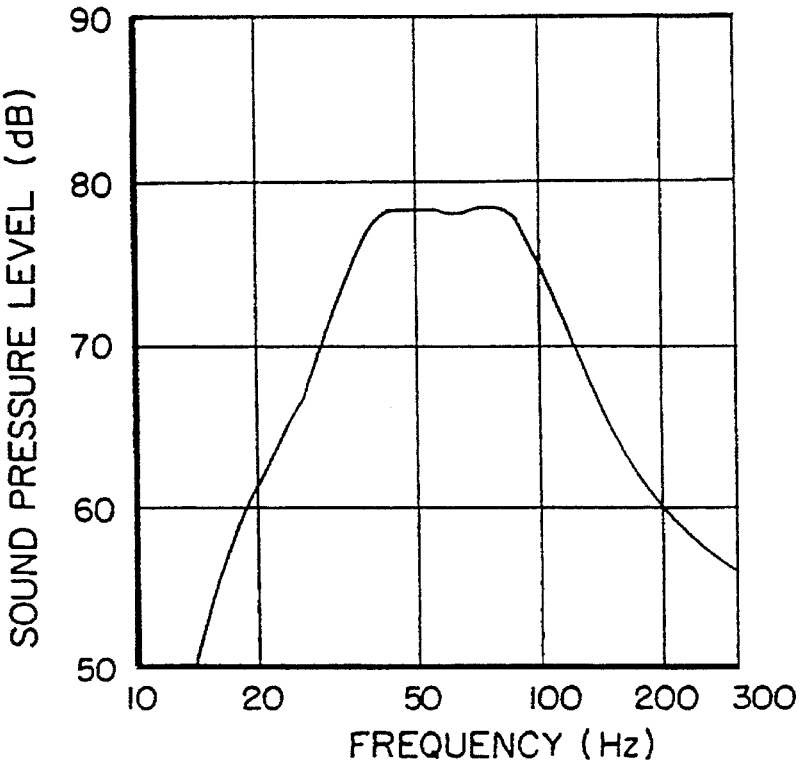
FIG. 19 is an actual measured sound pressure level-frequency characteristic curve of the bass reproduction speaker apparatus in the first example of the present invention.

FIG. 18 shows an actual measured sound pressure level-frequency characteristic curve in the case where the MFB is not conducted. This characteristic curve is similar to that of the curve e26 in FIG. 26. FIG. 19 shows an actual measured sound pressure level-frequency characteristic curve in the case where the acceleration-type MFB and the velocity-type MFB with the above-mentioned amount are conducted. It is apparent from FIG. 19 that a sound pressure level-frequency characteristic curve with almost a constant sound pressure level between about 40 Hz and about 100 Hz, which is similar to the computer simulation curve e28 in FIG. 28, is obtained. In addition, even though the total volume of the cabinet is as small as 4.85 liters, a practical maximum output sound pressure level of about 94 dB/meter is obtained at 40 Hz. This unit refers to a sound pressure level in a position 1 meter away from a thing which generates sound.

In the present example, as the sensor 5, a piezoelectric sensor is used. A moving-coil sensor, a light quantity detection sensor, a laser Doppler type sensor, an electrostatic sensor, and a hall element type sensor can be used, as will be appreciated, in other embodiments. For example, in the case of the moving-coil sensor, a voltage which is in proportion a velocity of the moving system of the speaker unit can be obtained, so that a voltage which is in proportion to an acceleration of the moving system of the speaker unit can be obtained by passing the detection signal from the sensor through a differentiating circuit in the feedback circuit. In the case of the light quantity detection sensor and the electrostatic sensor, a voltage which is in proportion to a displacement of the moving system can be obtained, so that a voltage which is in proportion to a velocity can be obtained by passing the detection signal from the sensor through a differentiating circuit in the feedback circuit once. In addition, a voltage which is in proportion to an acceleration can be obtained by passing the detection signal from the sensor through the differentiating circuit one more time. In the present example, the sensor 5 is attached to a center of the diaphragm of the speaker unit 1. The sensor 5 can be attached to an arbitrary portion of the moving system such as an external periphery of the diaphragm and a bobbin of the voice coil.

Furthermore, in the present example, a low-pass filter 7 is disposed in front of the amplifier 4. The band-pass speaker has a characteristic in which a signal with a high frequency is attenuated. Thus, in most cases, no problems arise from practical point of view, even though the low-pass filter is not disposed. Accordingly, it is not always required to use a low-pass filter.

As is understood from the above-mentioned description, according to the present invention, the vibration of the moving system of the speaker unit is detected by the sensor, and the detection signal from the sensor is fed back to the amplifier by the feedback circuit, whereby the velocity-type MFB and the acceleration-type MFB are conducted. Because of this structure, the electromagnetic damping resistance and the effective moving mass of the speaker unit can equivalently be increased in a great amount. Thus, peaks can be suppressed while the resonance frequencies $f_1$ and $f_2$ are lowered under the condition of a large effective diaphragm area of the speaker unit, and the speaker apparatus has effects of outputting a signal with a constant sound pressure level in a wide range of deep bass and ultra bass at a high maximum output sound pressure level in spite of its small size.

Example 2

Figure 2:
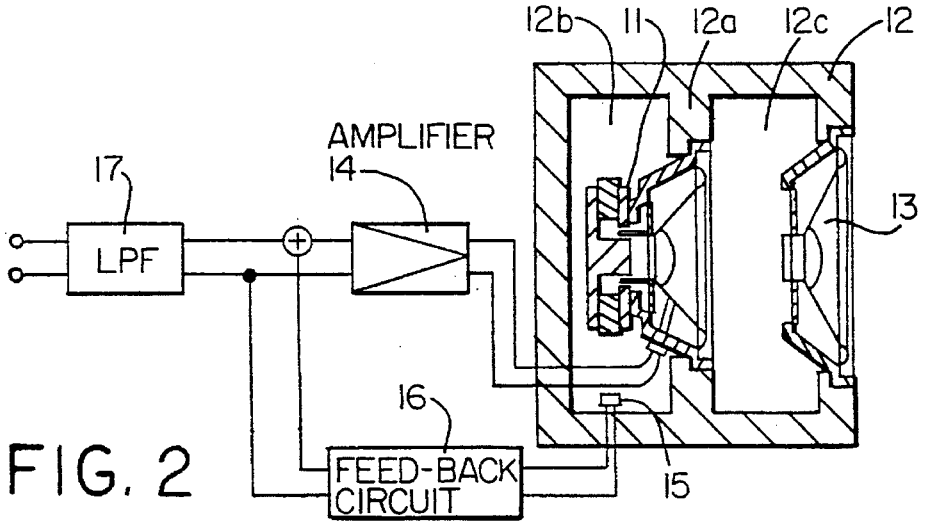
FIG. 2 is a block diagram showing a bass reproduction speaker apparatus in a second example of the present invention.

A second example of the present invention will be described with reference to FIG. 2. In FIG. 2, a speaker unit 11, a cabinet 12, a cavity division member 12*a*, a back cavity 12*b*, a front cavity 12*c*, a passive radiator 13, an amplifier 14, and a low-pass filter 17 are the same as those in Example 1 with the exception that ten has been added to the respective reference numerals, so that the description thereof is omitted. In the present example, a microphone 15 is used instead of the sensor 5, and is provided in the back cavity 12*b*. As the microphone 15, an electret capacitor microphone with a size of ø10 mm×6 mm is used.

The microphone 15 detects a sound pressure level in the back cavity 12*b*. The sound pressure level in the back cavity 12*b* is in proportion to a displacement of the moving system of the speaker unit 11 when the sound pressure level has a wavelength in a range sufficiently larger than the length of each edge of the back cavity 12*b*, i.e., the wavelength is in a bass band of 200 to 300 Hz. The microphone 15 can detect the displacement of the moving system of the speaker unit 11. The detection signal from the microphone 15 is fed back to the amplifier 14 by a feedback circuit 16 so that the velocity-type MFB and the acceleration-type MFB are conducted. More specifically, in the case where the velocity-type MFB is conducted in the feedback circuit 16, the level of the detection signal from the microphone 15 is determined by controlling the gain thereof in the feedback circuit 16 so that the electromagnetic damping resistance of the speaker unit 11 equivalently becomes 45.7 g.Ω. In the case of the velocity-type MFB, the detection signal from the microphone 15 is converted to a voltage which is in proportion to the velocity of the moving system by being passed through a differentiating circuit. Moreover, in the case where the acceleration-type MFB is conducted in the feedback circuit 16, the level of the detection signal from the microphone 15 is determined by controlling the gain thereof in the feedback circuit 16 so that the effective moving mass of the speaker unit 11 becomes 105 g. In the case of the acceleration-type MFB, the detection signal from the microphone 15 is converted to a voltage which is in proportion to the velocity of the moving system by being passed through the differentiating circuit twice. When a signal with a high frequency is fed back by the MFB, the output signal from the amplifier becomes unstable, so that the feedback amount is attenuated in a high frequency band by providing the low-pass filter with a cutoff frequency of 1.2 kHz in the feedback circuit 16.

Accordingly, the operation of the present example is the same as that of Example 1. An actual measured sound pressure level-frequency characteristic curve similar to that of FIG. 19, having a plateau between about 40 Hz and about 100 Hz is obtained. In addition, although the volume of the cabinet 12 is as small as 4.85 liters, an actual maximum output sound pressure level of about 94 dB/meter is obtained at 40 Hz.

As described above, the same effects as those of Example 1 are obtained. Moreover, in the present example, the microphone 15 is used instead of the sensor 5, so that it is not required to attach the sensor 5 to the moving system of the speaker unit 11 and it is not required to handle a lead wire presented by the sensor 5. Thus, the present example also has the effect of a simplified construction of a bass reproduction speaker apparatus.

Example 3

Figure 3:
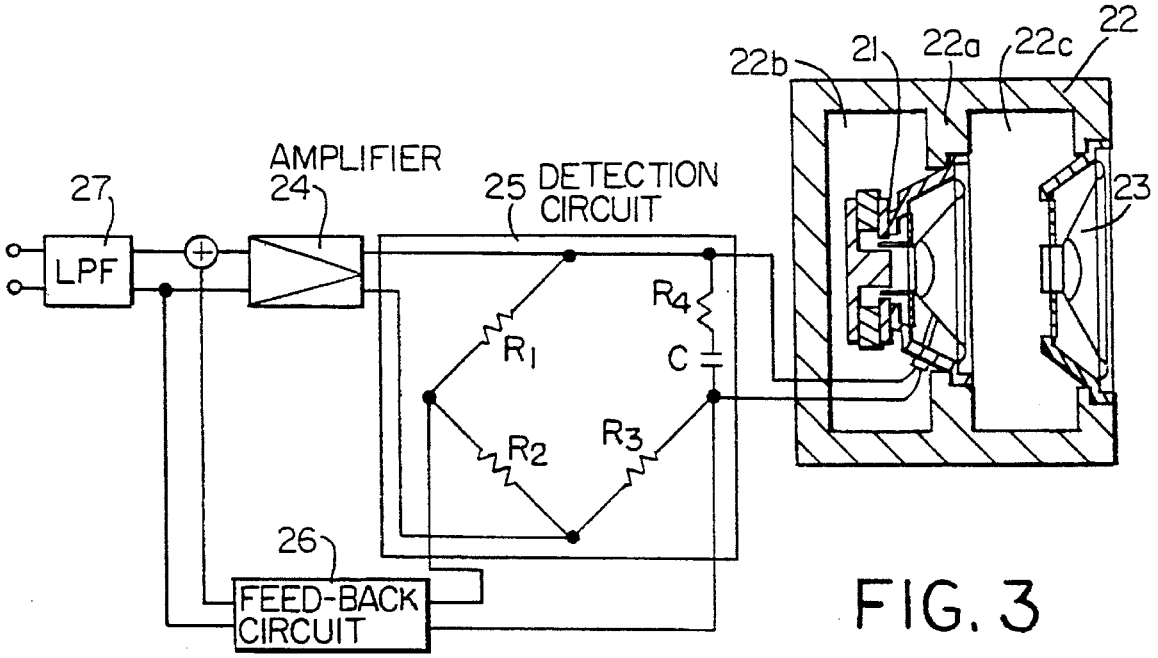
FIG. 3 is a block diagram showing a bass reproduction speaker apparatus in a third example of the present invention.

A third example will be described with reference to FIGS. 3, 15, 16, and 17. In FIG. 3, a speaker unit 21, a cabinet 22, a cavity division member 22*a*, a back cavity 22*b*, a front cavity 22*c*, a passive radiator 23, an amplifier 24, and a low-pass filter 27 are the same as those of Example 1 with the exception that between has been added to the respective reference numerals, so that the description thereof is omitted. In the present example, a detection circuit 25 is used instead of the sensor 5, and is provided between the amplifier 24 and the speaker unit 21. A feedback circuit 26 is disposed between the low-pass filter 27 and the detection circuit 25.

The detection circuit 25 is constituted by a balanced bridge circuit having a resistance $R_1$ (10 kΩ), a resistance $R_2$ (1.14 kΩ), a resistance $R_3$ (0.47Ω), and a voice coil of the speaker unit 21 as a side; a resistance $R_4$ (5.6Ω) for correcting voice coil impedance which corrects the increase in impedance due to inductance of the voice coil of the speaker unit 21; and a capacitor C (39 μF). The detection signal from the detection circuit 25 is a bridge output voltage which is in proportion to the velocity of the moving system of the speaker unit 21. This will be described with reference to FIGS. 15, 16, and 17.

Figure 15:
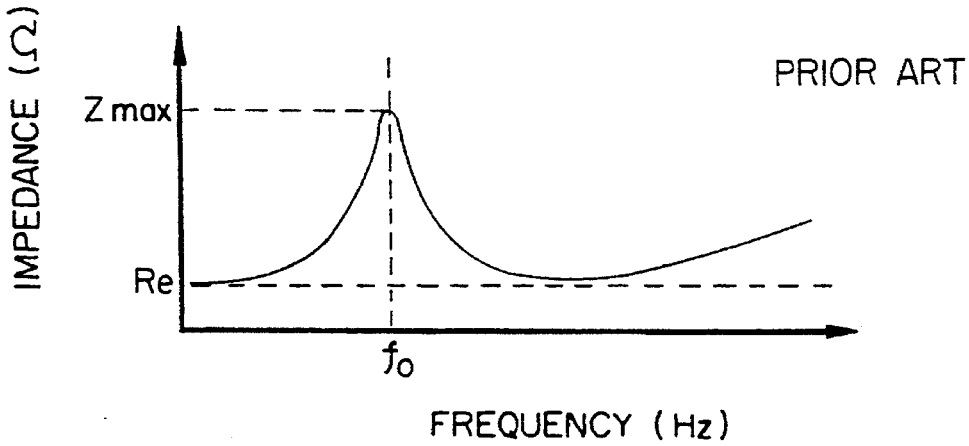
FIG. 15 is an impedance-frequency characteristic curve of a voice coil of an ordinary speaker.

FIG. 15 shows an impedance-frequency characteristic curve of an ordinary speaker. As is understood from FIG. 15, the impedance is $R_e$ (DC resistance of the voice coil) at an extremely low frequency, reaches a peak $Z_{max}$ at a lowest resonance frequency $f_0$, approaches $R_e$ again in a band of medium-pitched frequencies, and is gradually increased in a band of high-pitched frequencies. In the case of a speaker having a strong magnetic circuit, $Z_{max}$ is in the range of about 200 to 300Ω.

Figure 16:
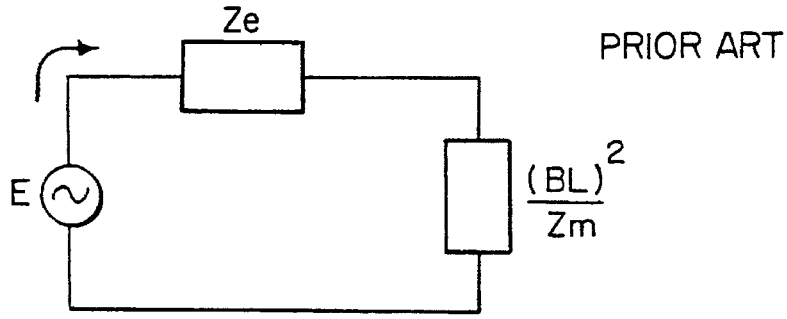
FIG. 16 is an equivalent circuit diagram showing a impedance component of the voice coil of the speaker.

FIG. 16 shows an impedance component of the voice coil of the speaker. $Z_m$ is a mechanical impedance of the moving system of the speaker unit, B is a magnetic flux density of the magnetic circuit, L is an effective conductor length of the voice coil, and V is a velocity of the vibration of the voice coil. $Z_e$ is a damping impedance of the voice coil, in which the DC resistance $R_e$ and the inductance component are connected in series. $Z_e$ is a voice coil impedance under the condition that the moving system of the speaker is fixed. $(BL)^2/Z_m$ is a motional impedance of the voice coil, and is caused by a reverse electromotive voltage E of the voice coil generated when the moving system vibrates. The reverse electromotive voltage E has an relationship: $E=BL\times V$ according to Fleming's rule, so that the reverse electromotive voltage E of the voice coil is in direct proportion to the velocity of the moving system.

Figure 17:
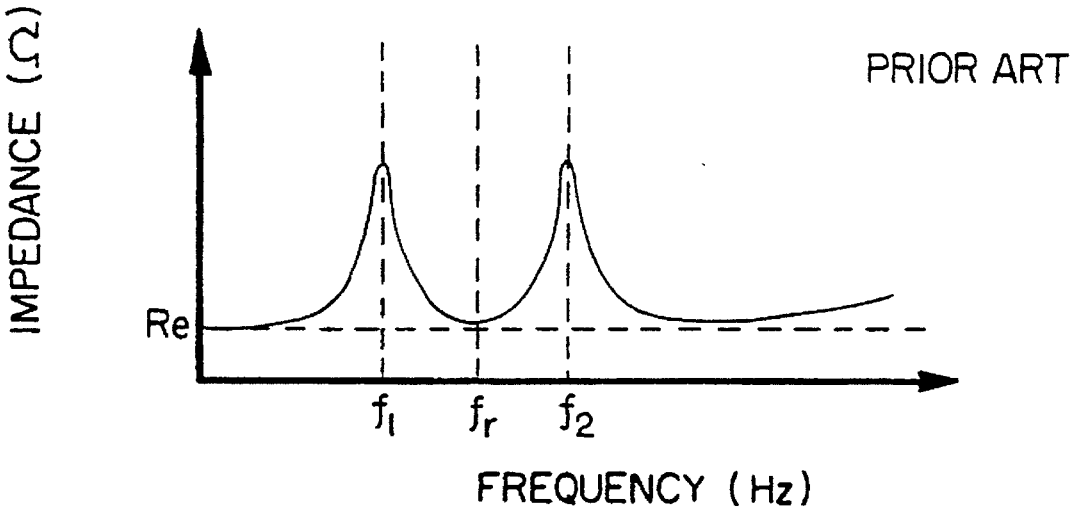
FIG. 17 is an impedance-frequency characteristic curve of a band-pass speaker.

The impedance-frequency characteristic curve shown in FIG. 15 is obtained by superimposing the motional impedance on the DC resistance of the voice coil and the inductance component. In FIG. 17, an impedance-frequency characteristic curve of a band-pass speaker is shown. In this curve, the motional impedance is also superimposed on the DC resistance of the voice coil and the inductance component.

Here, the voice coil of the speaker unit 21 is connected to one side of the bridge circuit in the detection circuit 25 of FIG. 3, and the bridge circuit is balanced under the relationship: $R_e:R_3=R_1:R_2$. In addition, the resistance for correcting the voice coil impedance is inserted into the bridge circuit. In this way, a voltage caused by the DC resistance component and the inductance component of the voice coil is canceled and is not output from the bridge circuit. As a result, a voltage caused by the motional impedance component alone, i.e., a reverse electromotive voltage generated in proportion to the velocity of the moving system of the speaker unit 21 alone is output from the bridge circuit. That is, a signal which is in proportion to the velocity of the moving system of the speaker unit 21 can be detected by the detection circuit 25.

Practically, there is a DC resistance of a lead for connection in the speaker unit 21, and a small amount of capacitance component is contained in the voice coil damping impedance. Therefore, it is required to finely adjust the values of each element of the bridge circuit in view of these problems. For this reason, the values of each element of the bridge circuit in the detection circuit 25 of the present example are not exactly in accordance with the above-mentioned relationship.

Figure 25:
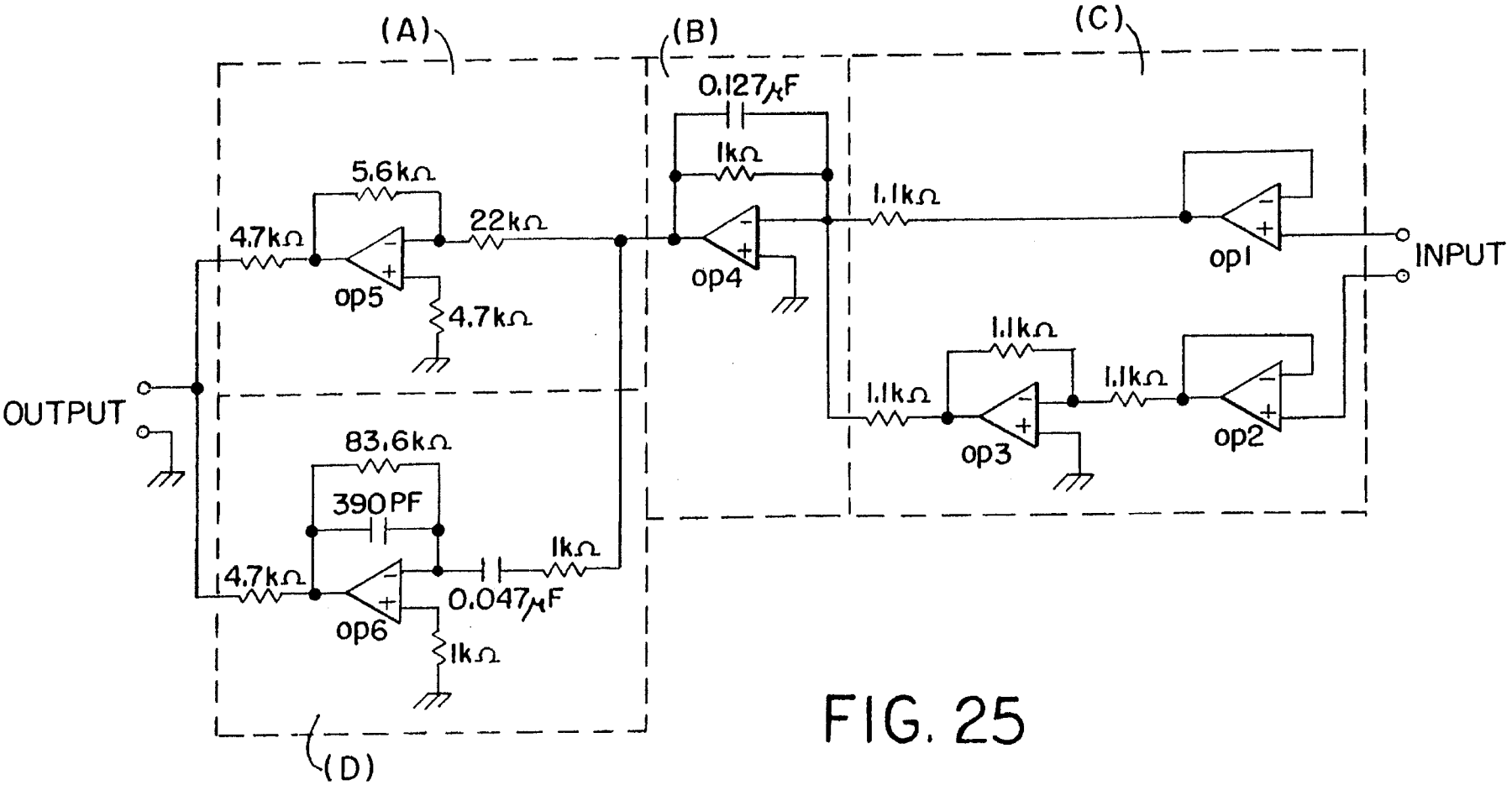
FIG. 25 is a diagram of a feedback circuit in the third example of the present invention.

As is described above, the detection signal from the detection circuit 25 is a voltage which is in proportion to the velocity of the moving system of the speaker unit 21. The detection signal is fed back to the amplifier 24 by the feedback circuit 26 so that the velocity-type MFB and the acceleration-type MFB are conducted. FIG. 25 shows a diagram of the feedback circuit 26. In FIG. 25, (A) is a gain-control circuit section for the velocity-type MFB; (B) is a low-pass filter section; (C) is a buffer circuit section; and (D) is a differentiating circuit and a gain-control circuit section for the acceleration-type MFB. More specifically, in the case where the velocity-type MFB is conducted in the feedback circuit 26, the level of the detection signal from the detection circuit 25 is determined by controlling the gain thereof in the feedback circuit 26 so that the electromagnetic damping resistance of the speaker unit 21 equivalently becomes 45.7 g.Ω. Moreover, in the case where the acceleration-type MFB is conducted in the feedback circuit 26, the level of the detection signal from the detection circuit 25 is determined by controlling the gain thereof in the feedback circuit 26 so that the effective moving mass of the speaker unit 21 equivalently becomes 105 g. In the case of the acceleration-type MFB, the detection signal from the detection circuit 25 is converted to a voltage which is in proportion to the velocity of the moving system by being passed through a differentiating circuit. When a signal with a high frequency is fed back by the MFB, the output of the amplifier becomes unstable, so that the feedback amount is attenuated in a high frequency band by providing the low-pass filter with a cutoff frequency of 1.2 kHz in the feedback circuit 26.

Accordingly, the operation of the present example is the same as that of Example 1. An actual measured sound pressure level-frequency characteristic curve similar to that of FIG. 19, having a plateau between about 40 Hz and about 100 Hz is obtained. In addition, although the volume of the cabinet 22 is as small as 4.85 liters, an actual maximum output sound pressure level of about 94 dB/meter is obtained at 40 Hz.

In the present example, the resistance $R_4$ and the capacitor C are provided in the detection circuit 25, whereby the voice coil impedance is corrected. Instead of this, a voice coil impedance can be corrected by connecting a small coil to the resistance $R_3$ in series, by connecting a small capacitor to the resistance $R_2$ in parallel, etc. In the case where the inductance of the voice coil is negligibly small because the diameter of the voice coil is small, a copper short ring is attached to a yoke of the magnetic circuit, or the like, the voice coil impedance correction can be omitted.

As described above, the same effects as those in Example 1 can be obtained in the present example. In addition, since the detection circuit 25 provided between the speaker unit 21 and the amplifier 24 is used instead of the sensor 5, it is not required to dispose the sensor 5 in the speaker unit 21 or to dispose the microphone 15 in the cabinet, resulting in a further simplified construction of the bass reproduction speaker apparatus.

Example 4

Figure 4:
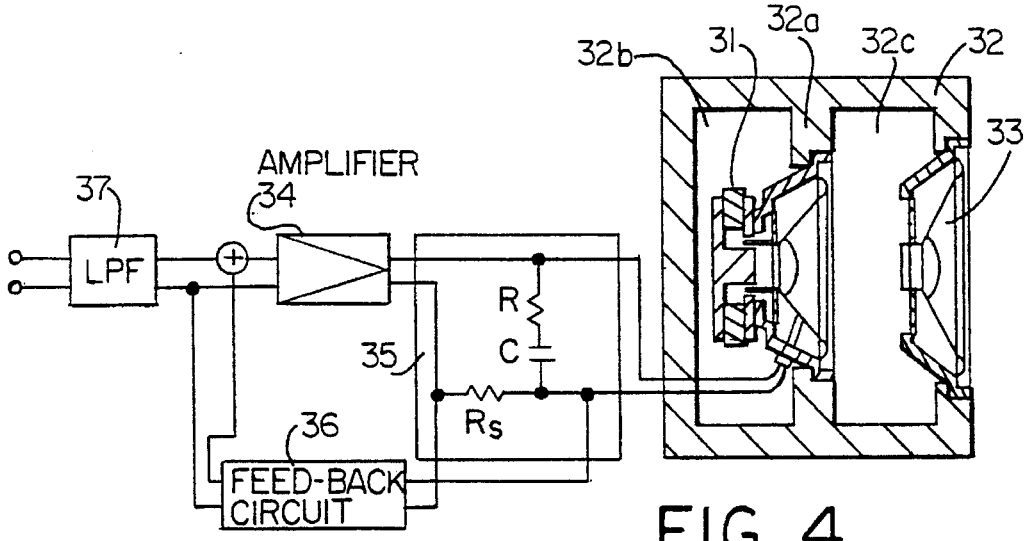
FIG. 4 is a block diagram showing a bass reproduction speaker apparatus in a fourth example of the present invention.

A fourth example of the present invention will be described with reference to FIG. 4. In FIG. 4, a speaker unit 31, a cabinet 32, a cavity division member 32*a*, a back cavity 32*b*, a front cavity 32*c*, a passive radiator 33, an amplifier 34, and a low-pass filter 37 are the same as those in Example 1 with the exception that thirty has been added to the respective reference numerals, so that the description thereof is omitted. In the present example, a detection circuit 35 is used instead of the sensor 5 as described in Example 3, and is provided between the amplifier 34 and the speaker unit 31. However, in the present example, the detection circuit 35 is constituted by a resistance $R_s$ (0.22Ω), a resistance R (5.6Ω) for correcting a voice coil impedance of the speaker unit 31, and a capacitor C (39 μF). A detection signal from the detection circuit 35, i.e., an output voltage of the resistance $R_s$ is in inverse proportion to the velocity of the moving system of the speaker unit 31. This will be described in detail below.

Since the resistance $R_s$ of the detection circuit 35 has a much smaller value compared with the voice coil impedance of the speaker unit 31, an output voltage from each end of the resistance $R_s$ becomes a voltage which is in inverse relationship to an impedance-frequency characteristic curve shown in FIG. 17. That is, an impedance-frequency characteristic curve which has minimum values at two resonance frequencies $f_1$ and $f_2$ and has a maximum value at antiresonant frequency $f_r$. When a magnetic flux density B of the magnetic circuit and an effective conductor length L of the voice coil are great to a certain degree, and the product BL is sufficiently large as in the present example, the motional impedance becomes dominant in a bass band and the damping impedance becomes negligible. More specifically, the voltage from each end of the resistance $R_s$, i.e., the detection signal from the detection circuit 35 becomes a voltage which is in inverse proportion to the motional impedance component, i.e., a voltage which is in inverse proportion to the reverse electromotive voltage of the voice coil. As described in Example 3, since the reverse electromotive voltage of the voice coil is in direct proportion to the velocity of the moving system, the detection signal from the detection circuit 35 becomes a voltage which is in inverse proportion to the velocity of the moving system of the speaker unit 31.

Thus, the detection signal is fed back under the condition that a phase thereof is not inverted (i.e., positive feedback), whereby the velocity-type MFB is conducted. That is to say, the detection signal becomes minimum at two resonance frequencies $f_1$ and $f_2$, and even though the detection signal is fed back to the amplifier 34, the output level of the amplifier 34 is negligibly changed. However, the detection signal becomes large at an antiresonant frequency $f_r$ and at a frequency which is smaller than $f_1$ or larger than $f_2$; and this detection signal is fed back to the amplifier 34, whereby the output level of the amplifier 34 is increased. Since the amplifier 34 operates so as to relatively suppress the peaks at $f_1$ and $f_2$, the same operation as that of the velocity-type MFB can be conducted. In addition, a voltage, which is in inverse proportion to the velocity of the moving system of the speaker unit 31, can be obtained by passing the detection signal through the differentiating circuit. Thus, the same operation as that of the acceleration-type MFB can be obtained by positively feeding back the detection signal to the amplifier 34.

As described above, in the case where the velocity-type MFB is conducted in the feedback circuit 36, the level of the detection signal from the detection circuit 35 is determined by controlling the gain thereof in the feedback circuit 36 so that the electromagnetic damping resistance of the speaker unit 31 equivalently becomes 45.7 g.Ω. Moreover, in the case where the acceleration-type MFB is conducted in the feedback circuit 36, the level of the detection signal from the detection circuit 35 is determined by controlling the gain thereof in the feedback circuit 36 so that the effective moving mass of the speaker unit 31 equivalently becomes 105 g.Ω. When a signal with a high frequency is fed back by the MFB, the output of the amplifier becomes unstable, so that the feedback amount is attenuated in a high frequency band by providing the low-pass filter with a cutoff frequency of 1.2 kHz in the feedback circuit 36.

Accordingly, the operation of the present example is the same as that of Example 1. An actual measured sound pressure level-frequency characteristic curve similar to that of FIG. 19, having a plateau between about 40 Hz and about 100 Hz is obtained. In addition, although the volume of the cabinet 32 is as small as 4.85 liters, an actual maximum output sound pressure level of about 94 dB/meter is obtained at 40 Hz.

In the case where the inductance of the voice coil is negligibly small because the diameter of the voice coil is small, a copper short ring is attached to a yoke of the magnetic circuit, or the like, the voice coil impedance correction can be omitted.

As described above, the same effects as those of Example 3 can be obtained. In addition, the present example has the effect that a detection circuit is simplified.

Example 5

Figure 5:
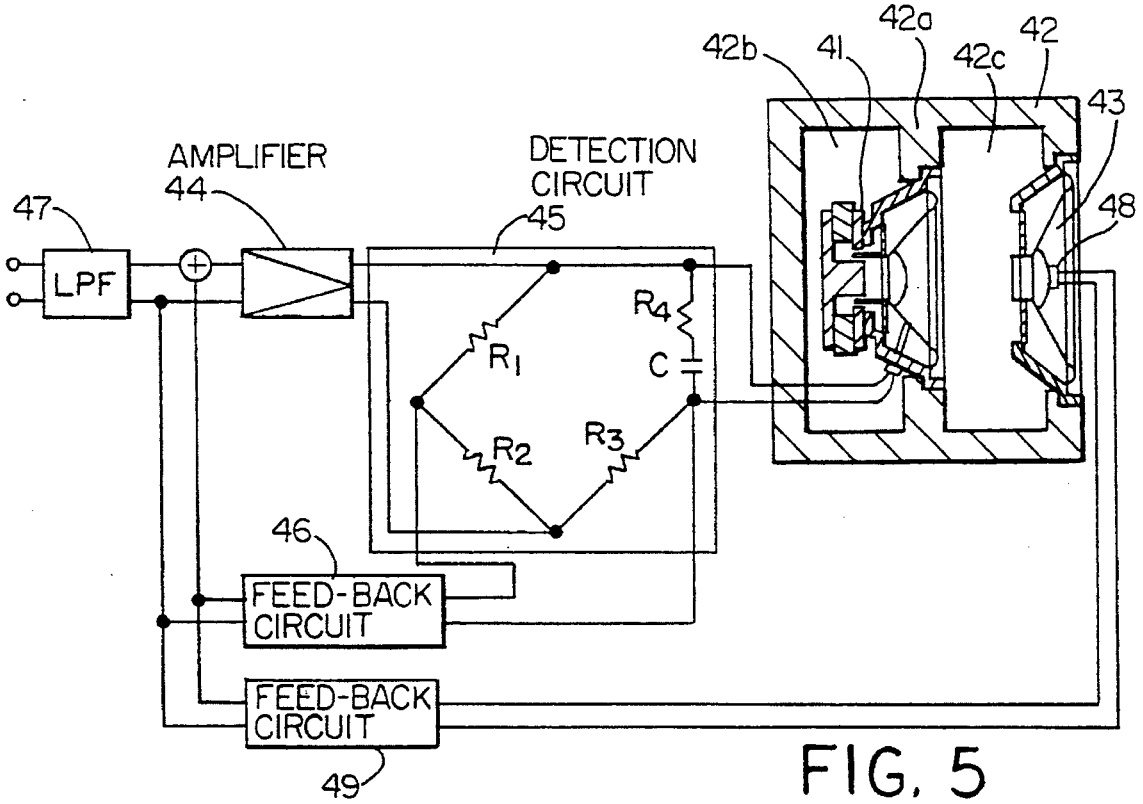
FIG. 5 is a block diagram showing a bass reproduction speaker apparatus in a fifth example of the present invention.

A fifth example of the present invention will be described with reference to FIG. 5. In FIG. 5, a speaker unit 41, a cabinet 42, a cavity division member 42*a*, a back cavity 42*b*, a front cavity 42*c*, a passive radiator 43, an amplifier 44, a detection circuit 45, a first feedback circuit 46, and a low-pass filter 47 are the same as those in Example 3 with the exception that twenty has been added to the respective reference numerals, and the velocity-type MFB and the acceleration-type MFB which are similar to those in Example 3 are conducted. Particularly, in the present example, a sensor 48 which is another detector for detection the vibration of the moving system is provided, and the detection signal from the sensor 48 is fed back to the amplifier 44 by a second feedback circuit 49 to conduct the acceleration-type MFB in the passive radiator 43.

In this structure, the same operation as those described in =he above-mentioned examples can be obtained in the speaker unit 41. In the present example, the same operation of the MFB as that described in the introduction part of Description of the Preferred Embodiments is conducted in the passive radiator 43. That is, when the acceleration-type MFB is conducted in the passive radiator 43, the amplifier 44 operates so as to obtain an acceleration-frequency characteristic curve of the moving system of the passive radiator 43 in which a sound pressure level is constant in a wide range of frequency. As described in the introduction part of Description of the Preferred Embodiments, this operation is an equivalent to the case where the effective moving mass $M_p$ of the passive radiator of the electrical acoustic equivalent circuit in FIG. 11 is made large and corresponds to the case where the moving system of the passive radiator is made heavy. The effective moving mass $M_p$ of the passive radiator can be increased in a great amount by increasing the feedback amount.

In the present example, the effective vibration radius of the passive radiator 43 is 75 mm in the same way as in the above-mentioned examples; however, the effective moving mass thereof is 90 g. As the sensor 48, a piezoelectric sensor is used. The detection signal from the sensor 48 is a voltage which is in proportion to the acceleration of the moving system of the passive radiator 43. Thus, in the case where the MFB is conducted in the second feedback circuit 49, the level of the detection signal from the sensor 48 is determined by controlling the gain thereof in the second feedback circuit 49 so that the effective moving mass of the passive radiator 43 equivalently becomes 140 g. When a signal with a high frequency is fed back by the MFB, the output signal of the amplifier becomes unstable, so that the feedback amount is attenuated in a high frequency band by providing the low-pass filter with a cutoff frequency of 500 Hz in the second feedback circuit 49.

Figure 20:
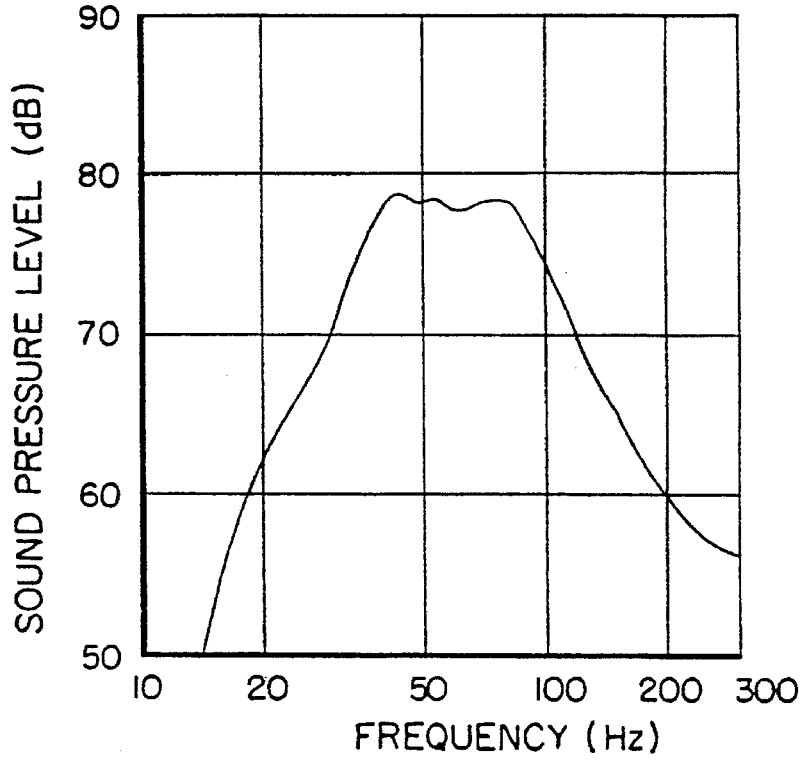
FIG. 20 is an actual measured sound pressure level-frequency characteristic curve of the bass reproduction speaker apparatus in the fifth example of the present invention.

An actual measured sound pressure level-frequency characteristic curve of the bass reproduction speaker apparatus thus fabricated is shown in FIG. 20. As is understood from FIG. 20, the actual measured sound pressure level-frequency characteristic curve having a plateau between about 40 Hz and about 100 Hz is obtained. In addition, although the volume of the cabinet 42 is as small as 4.85 liters, an actual maximum output sound pressure level of about 92 dB/meter is obtained at 40 Hz.

In the present example, only the acceleration-type MFB is conducted in the passive radiator 43; however, the velocity-type MFB can also be conducted. In this way, the mechanical resistance $R_p$ of the passive radiator of the equivalent circuit in FIG. 11 can equivalently be increased in a great amount, so that the passive radiator 43 can be damped.

Moreover, in the present example, as another detector, the piezoelectric sensor 48 is used; however, a moving-coil sensor, a light intensity detection sensor, a laser Doppler type sensor, an electrostatic sensor, a hall element type sensor, and sensors of other types can be used. The sensor 48 is attached to the center of the diaphragm of the passive radiator 43 in the present example; however, the sensor 48 can be attached to an arbitrary portion of the moving system such as an external periphery of the diaphragm.

Furthermore, in the present example, the detection circuit 45 is used for the purpose of conducting the MFB in the speaker unit 41. Instead of the detection circuit 45, a sensor or a microphone can be used as in Examples 1 and 2.

As described above, the same effects as those of the above-mentioned examples can be obtained in the present example. In addition, the acceleration-type MFB is conducted in the passive radiator in the present example, so that it is not required to increase the effective moving mass in a great amount. Thus, it becomes easier to manufacture the passive radiator; and the vibration of the cabinet, which is caused by the reaction at the time that the moving system of the passive radiator vibrates, can be attenuated.

Example 6

Figure 6:
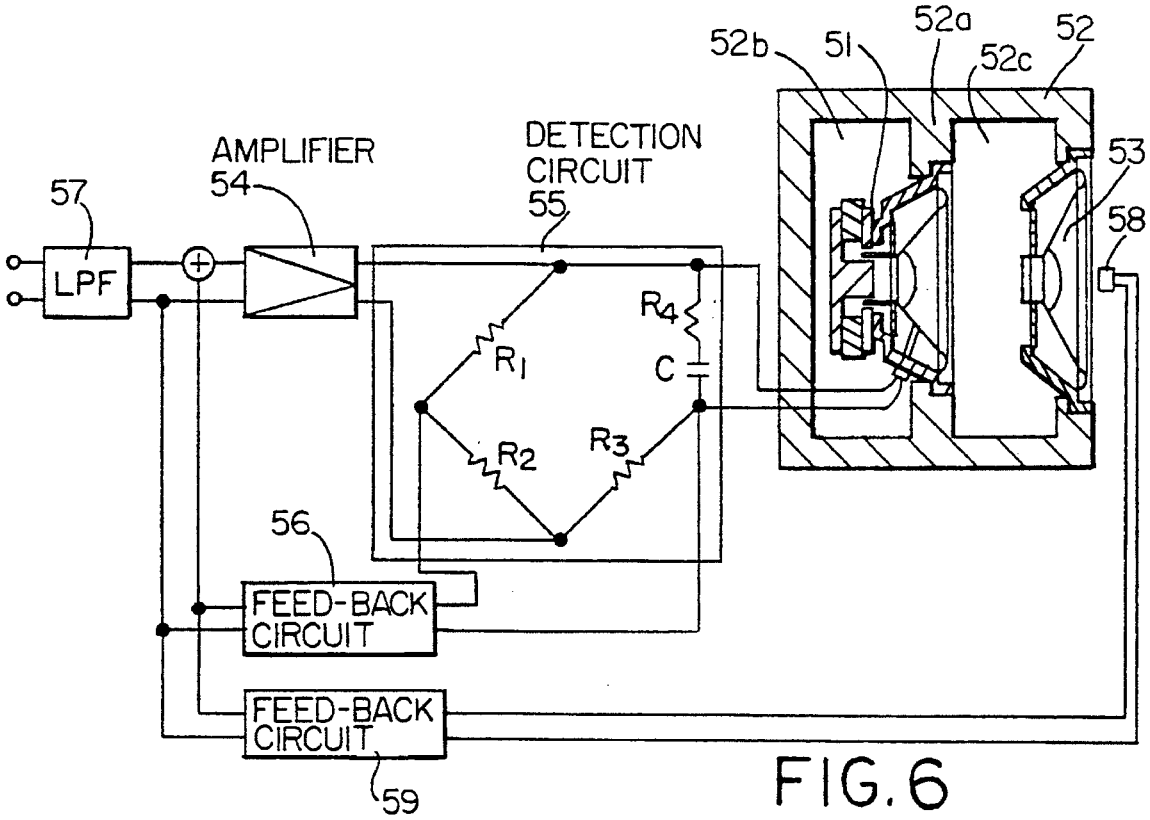
FIG. 6 is a block diagram showing a bass reproduction speaker apparatus in a sixth example of the present invention.

A sixth example of the present invention will be described with reference to FIG. 6. In FIG. 6, a speaker unit 51, a cabinet 52, a cavity division member **52*a*, a back cavity 52*b*, a front cavity 52*c*, a passive radiator 53, an amplifier 54, a detection circuit 55, a first feedback circuit 56, and a low-pass filter 57 are the same as those in Example 5 with the exception that ten has been added to the respective reference numerals. The velocity-type MFB and acceleration-type MFB which are similar to those in Example 5 are conducted. In the passive radiator 63, the MFB is also conducted. In the present example, as a detector for detecting the vibration of the moving system of the passive radiator 53, a microphone 58 is used instead of the sensor 48 as used in Example 5. The microphone 58 is positioned outside of the cabinet 52 and 5 cm away from the front face of the diaphragm of the passive radiator 53. The detection signal from the microphone 58 is fed back to the amplifier 54 by a second feedback circuit 59, whereby the acceleration-type MFB is conduced in the passive radiator 53. The passive radiator 53** has an effective vibration radius of 75 mm and an effective moving mass of 90 g in the same way as in Example 5.

As the microphone 58, an electret capacitor microphone with a size of ø10 mm×6 mm is used. Since the microphone 58 is positioned outside of the cabinet 52, the detection signal thereof is in proportion to the sound pressure radiated from the passive radiator 53. The irradiated sound pressure of the passive radiator 53 is in proportion to the acceleration of the moving system. Since the detection signal of the microphone 58 is a voltage which is An proportion to the acceleration of the moving system of the passive radiator 53. Thus, in the case where the acceleration-type MFB is conducted in the second feedback circuit 59, the level of the detection signal from the microphone 58 is determined by controlling the gain thereof in the second feedback circuit 59 so that the effective moving mass of the passive radiator 53 equivalently becomes 140 g. When a signal with a high frequency is fed back by the MFB, the output signal from the amplifier becomes unstable, so that the feedback amount is attenuated in a high frequency band by providing the low-pass filter with a cutoff frequency of 500 Hz in the second feedback circuit 59.

As described above, the same operation as that of Example 5 is performed in the present example. An actual measured sound pressure level-frequency characteristic curve having a plateau between about 40 Hz and about 100 Hz as shown in FIG. 20 is obtained. In addition, although the volume of the cabinet 52 is as small as 4.85 liters, an actual maximum output sound pressure level of about 92 dB/meter ks obtained at 40 Hz.

In the present example, only the acceleration-type MFB is conducted in the passive radiator 53; however, the velocity-type MFB can also be conducted. The microphone 58 can be positioned beside the face to which the passive radiator 53 of the cabinet 52 is attached, etc., instead of being positioned in the vicinity of the front face of the diaphragm of the passive radiator 53.

Moreover, in the present example, the detection circuit 55 is used for conducting the MFB in the speaker unit 51. Instead of that, a sensor or a microphone as in Examples 1 and 2 can be used.

As described above, the effects of the present invention are the same as those in Example 6. In addition, the microphone 58 is used as another detector, so that it is not required to attach the detector to the moving system of the passive radiator 53. Moreover, it becomes easy to handle a lead from the detection circuit, resulting in a simplified fabrication of the bass reproduction speaker apparatus.

Example 7

Figure 7:
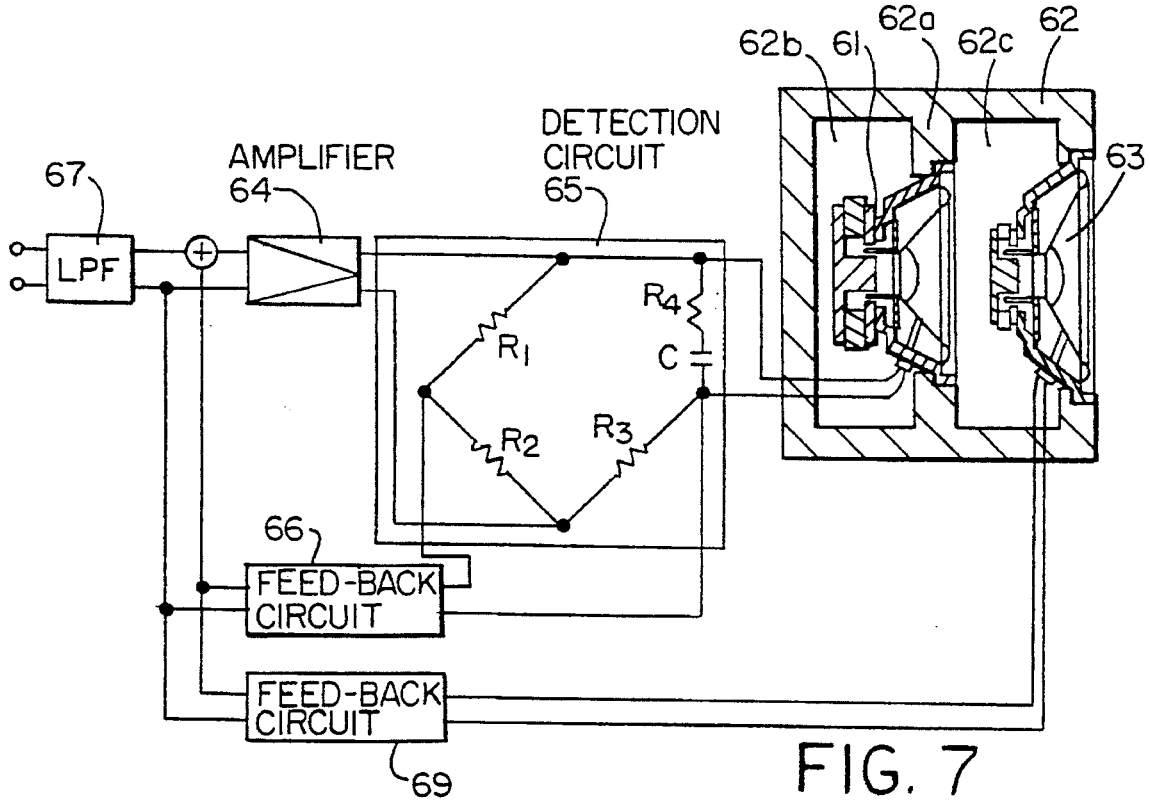
FIG. 7 is a block diagram showing a bass reproduction speaker apparatus in a seventh example of the present invention.

A seventh example of the present invention will be described with reference to FIG. 7. In FIG. 7, a first speaker unit 61, a cabinet 62, a cavity division member 62*a*, a back cavity 62*b*, a front cavity 62*c*, an amplifier 64, a detection circuit 65, a first feedback circuit 66, and a low-pass filter 67 are the same as those in Example 3 with the exception that forty has been added to the respective reference numerals. The velocity-type MFB and the acceleration-type MFB which are similar to those in Example 3 are conducted. In particular, in the present example, a second speaker unit 63 is used instead of the passive radiator 23 and a magnetic circuit thereof is used as a sensor. More specifically, the second speaker unit 63 has a magnetic circuit and a voice coil, and a voltage is generated in the voice coil due to the vibration of the diaphragm, so that this phenomenon is used as a moving-coil sensor. The second speaker unit 63 has an effective vibration radius of 75 mm and an effective moving mass of 90 g, and a voice coil impedance thereof is made as high as 200Ω so as to increase the detecting sensitivity as the sensor.

The detection signal of the voice coil of the second speaker unit 63 is a voltage which is proportion to the velocity of the moving system of the second speaker unit 63 according to Fleming's rule. In the case where the acceleration-type MFB is conducted in a second feedback circuit 69, the level of the detection signal from the second speaker unit 63 is determined by controlling the gain thereof in the second feedback circuit 69 so that the effective moving mass of the second speaker unit 63 becomes 140 g. In the case of the acceleration-type MFB, the detection signal from the second speaker unit 63 is converted to a voltage which is in proportion to the acceleration of the moving system by being passed through a differentiating circuit. When a signal with a high frequency is fed back by the MFB, the output signal of the amplifier becomes unstable, so that the feedback amount is attenuated in a high frequency band by providing the low-pass filter with a cutoff frequency of 500 Hz in the second feedback circuit 69.

As described above, the same operation as that of Example 5 is performed in the present example. An actual measured sound pressure level-frequency characteristic curve having a plateau between about 40 Hz and about 100 Hz as shown in FIG. 20 is obtained. In addition, although the volume of the cabinet 62 is as small as 4.85 liters, an actual maximum output sound pressure level of about 92 dB/meter is obtained at 40 Hz.

In the present example, only the acceleration-type MFB is conducted in the second speaker unit 63; however, the velocity-type MFB can also be conducted.

Moreover, in the present example, the detection circuit 65 is used for conducting the MFB in the first speaker unit 61. Instead of that, a sensor or a microphone as in Examples 1 and 2 can be used.

As described above, the effects of the present invention are the same as those in Example 6. In addition, the second speaker unit 63 is used instead of the passive radiator 53, so that it is not required to attach the sensor to the passive radiator, resulting in a simplified fabrication of the bass reproduction speaker apparatus.

Example 8

Figure 8:
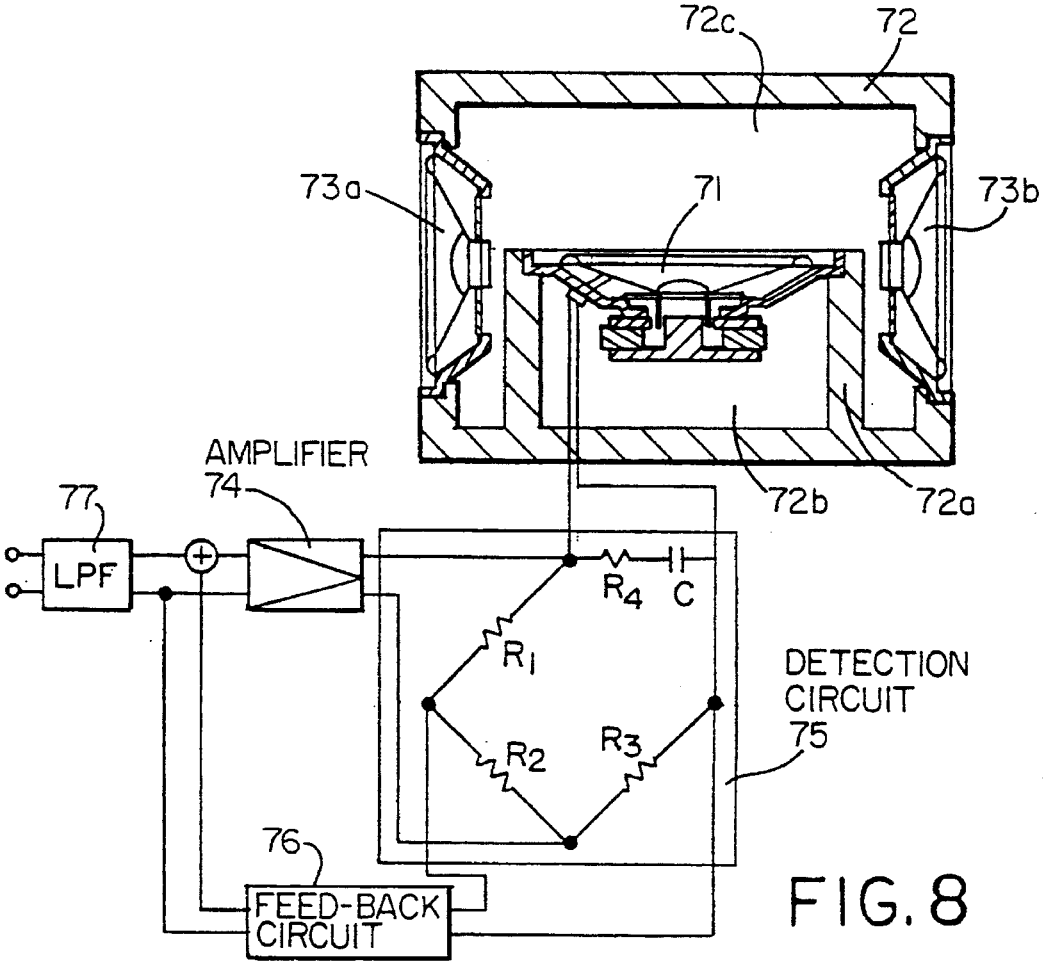
FIG. 8 is a block diagram showing a bass reproduction speaker apparatus in an eighth example of the present invention.

An eighth example will be described with reference to FIG. 8. In FIG. 8, a speaker unit 71 has a diameter of 46 cm, an effective vibration radius of 202 mm, an effective moving mass of 240 g, a magnet size of a magnetic circuit of ø200 mm×ø120 mm×25 mm, a diameter of a voice coil of ø100 mm, a magnetic flux density of the magnetic circuit of 1 tesla, an effective conductor length of the voice coil of 18.4 m, a DC resistance of the voice coil of 3.7Ω, a max linear excursion of ±8 mm, and a lowest resonance frequency of 20 Hz. The speaker unit 71 is attached to a cavity division member 72*a*. A passive radiator 73*a* Which has a diameter of 40 cm, an effective vibration radius of 163 mm, and an effective moving mass of 1600 g and is capable of significant vibration; and a passive radiator 73*b* which has the same effective diaphragm area and the effective moving mass as those of the passive radiator 73*a* are respectively attached to external sides of a cabinet 72 facing each other. A back cavity 72*b* and a front cavity 72*c* have an internal volume of 34 liters and 18 liters, respectively.

The speaker unit 71 is driven by an amplifier 74 with an output power of 800 W and an input voltage sensitivity of 1 V. A detection circuit 75 is constituted by a bridge circuit having a resistance R1 (10 kΩ), a resistance R2 (1.1 kΩ), a resistance R3 (0.47Ω), and a voice coil of the speaker unit 71 as a surround; a resistance R4 (4.7Ω) for correcting voice coil impedance which corrects the increase in impedance due to inductance of the voice coil of the speaker unit 71; and a capacitor C (47 μF). The detection circuit 75 is provided between the amplifier 74 and the speaker unit 71.

The detection signal of the detection circuit 75 is a voltage which is in proportion to the velocity of the moving system of the speaker unit 71. In the case where the velocity-type MFB is conducted in a feedback circuit 76, the level of the detection signal from the detection circuit 75 is determined by controlling the gain thereof in the feedback circuit 76 so that the electromagnetic damping resistance of the speaker unit 71 equivalently becomes 450 g.Ω. Moreover, in the case where the acceleration-type MFB is conducted in the feedback circuit 76, the level of the detection signal from the detection circuit 75 is determined by controlling the gain thereof in the feedback circuit 76 so that the effective moving mass of the speaker unit 71 equivalently becomes 990 g. In the case of the acceleration-type MFB, the detection signal from the detection circuit 75 is converted to a voltage which is in proportion to the acceleration of the moving system by being passed through a differentiating circuit. When a signal with a high frequency is fed back by the MFB, the output signal form the amplifier becomes unstable, so that the feedback amount is attenuated in a high frequency band by providing a low-pass filter with a cutoff frequency of 800 Hz in the feedback circuit 76.

A low-pass filter 77 with a cutoff frequency of 500 Hz is provided in front of the amplifier 74, thereby attenuating the sound output level in an unwanted band of frequencies.

Figure 21:
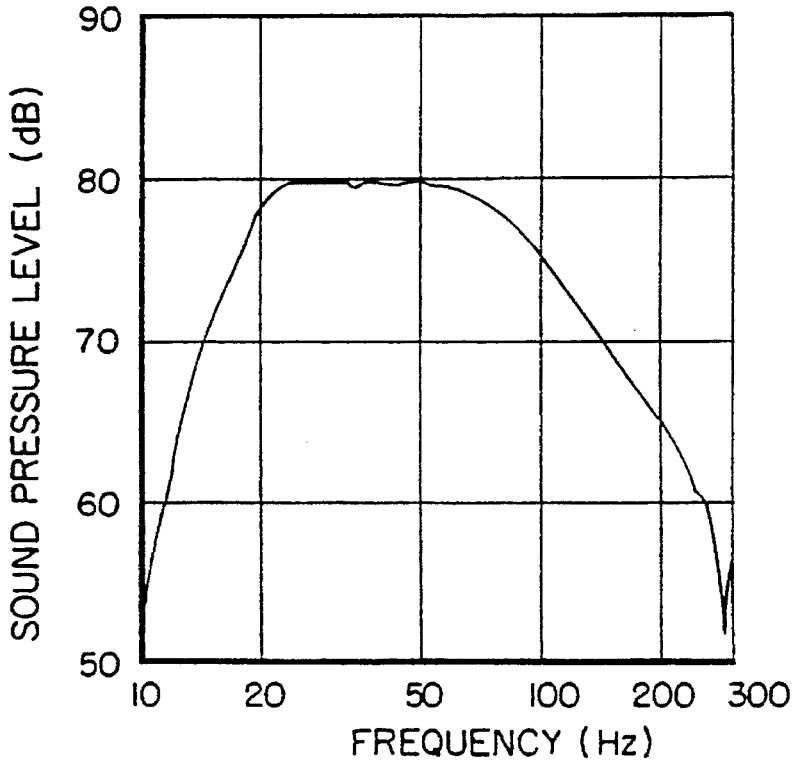
FIG. 21 is an actual measured sound pressure level-frequency characteristic curve of the bass reproduction speaker apparatus in the eighth example of the present invention.

An actual measured sound pressure level-frequency characteristic curve of the bass reproduction speaker apparatus thus fabricated is shown in FIG. 21. As is understood from FIG. 21, the sound pressure level-frequency characteristic curve has an almost flat shape between about 20 Hz and about 70 Hz. In addition, even though the total internal volume of the cabinet 72 is as small as 52 liters, a very high practical maximum output sound pressure level of about 100 dB/meter can be obtained at 20 Hz.

Moreover, the passive radiators 73*a* and 73*b*, each having the same effective moving mass and effective diaphragm area, are attached to external sides of the cabinet facing each other, whereby the reaction, which is generated at the time that the moving system of the passive radiators 73*a* and 73*b* oscillate, is canceled. Because of this, in the present example, the vibration of the cabinet 72 becomes about 1/100 of the case where the passive radiators 73*a* and 73*b* are attached to one external side of the cabinet 72. Thus, unwanted resonant tones, vibration, and the like are barely generated even at a high output sound pressure level.

In the present example, the detection circuit 75 is used for conducting the MFB. Instead of that, a sensor or a microphone as in Examples 1 and 2 can be used. In addition, as described in Examples 5 and 6, the MFB can be conducted in the passive radiators 73*a* and 73*b* by using anther detection circuit and another feedback circuit. In this case, as described in Example 7, the second speaker unit can be used instead of the passive radiator.

As described above, the bass reproduction speaker apparatus of the present example can reproduce a deep bass and an ultra bass with a constant frequency at a high maximum sound output level in spite of its small size in the same way as in the above-mentioned examples. In addition, the vibration of the cabinet et a high output sound pressure level is remarkably small and unwanted resonant tones, vibration, and the like are not generated.

Example 9

Figure 9:
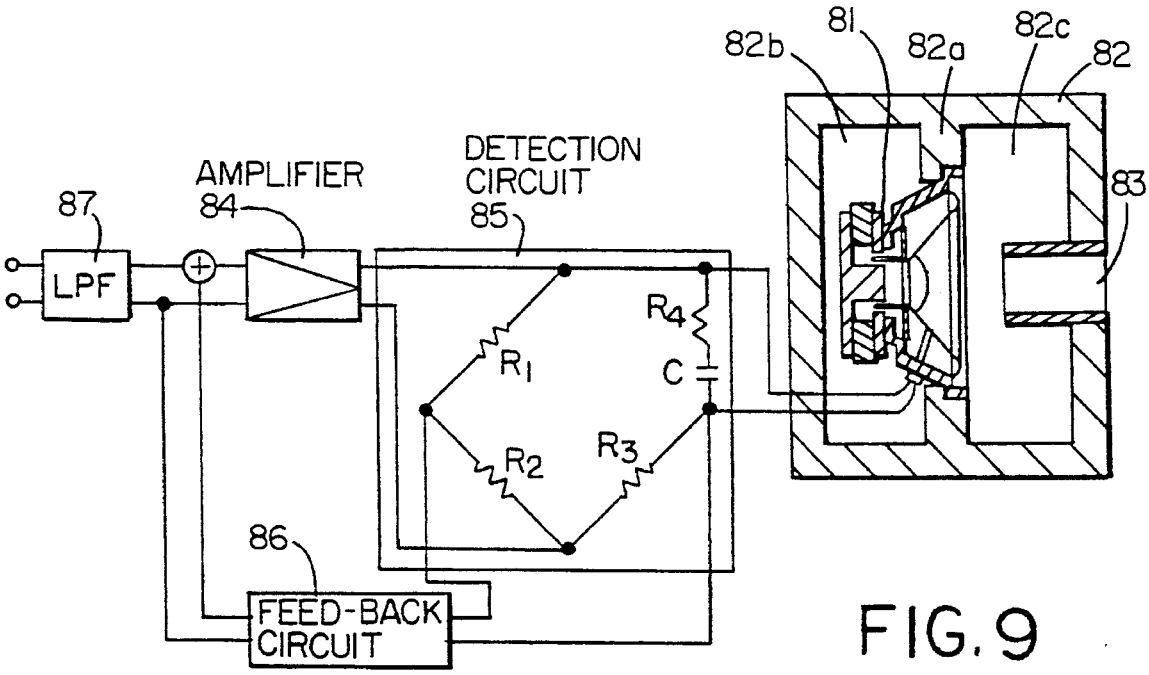
FIG. 9 is a block diagram showing a bass reproduction speaker apparatus in a ninth example of the present invention.

A ninth example of the present invention will be described with reference to FIG. 9. In FIG. 9, a speaker unit 81, an amplifier 84, a detection circuit 85, a feedback circuit 86, a low-pass filter 87 are the same as those in Example 3 with the exception that sixty is added to the respective reference numerals, so that the description thereof is omitted. In particular, in the present example, a port 83 is used instead of the passive radiator 23. A back cavity 82*b* of a cabinet 82 has an internal volume of 2.75 liters in the same way as in Example 3. An internal volume of a front cavity 82*c* is made 2.5 liters including the volume of the port 83. That is, a substantial internal volume of the front cavity 82*c* is 2.1 liters which is the same as that in Example 3.

The port 83 has an inside diameter of ø36 mm and a length of 340 mm. The effective moving mass of the air in the port 83 is 0.75 g. When this mass is converted in terms of an effective diaphragm area of the speaker unit 81 to obtain an equivalent mass, it is understood that the case where the port 83 is provided corresponds to the case where the passive radiator 23 with an effective vibration radius of 75 mm and an effective moving mass of 140 g is provided as described in Example 3. In the case of the port 83, the electrical equivalent circuit in FIG. 11 is in a condition that $C_p$ is short-circuited. $C_p$ is a negligible value, i.e., a sufficiently large value, so that this condition is the same as that in Example 3. Since the port 83 is long, the port 83 is gently bent in an L-shape and is accommodated in the front cavity 82*c*.

Accordingly, the operation of the bass reproduction speaker apparatus of the present example is the same as that in Example 3.

Figure 22:
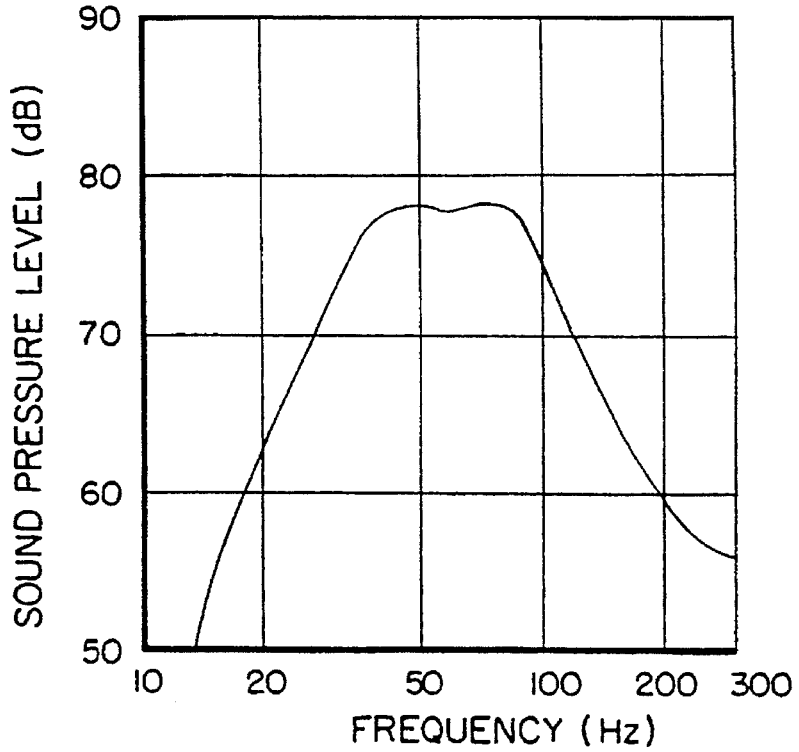
FIG. 22 is an actual measured sound pressure level-frequency characteristic curve of the bass reproduction speaker apparatus in the ninth example of the present invention.

An actual measured sound pressure level-frequency characteristic curve of the bass reproduction speaker apparatus of the present example is shown in FIG. 22. As is understood from FIG. 22, the characteristic curve has an almost flat shape between about 40 Hz and about 100 Hz. In addition, even though the total internal volume of the cabinet is as small as 5.25 liters, a high practical maximum output sound pressure level of about 90 dB/meter can be obtained at 40 Hz.

Moreover, in the present example, the detection circuit 85 is used for conducting the MFB. Instead of that, a sensor or a microphone as described in Examples 1 and 2 can be used.

As described above, the bass reproduction speaker apparatus of the present example can reproduce a deep bass and an ultra bass with a constant frequency at a maximum output sound pressure level in spite of its small size. In addition, the port with a simple structure is used, so that it costs less to manufacture the apparatus.

Example 10

Figure 10:
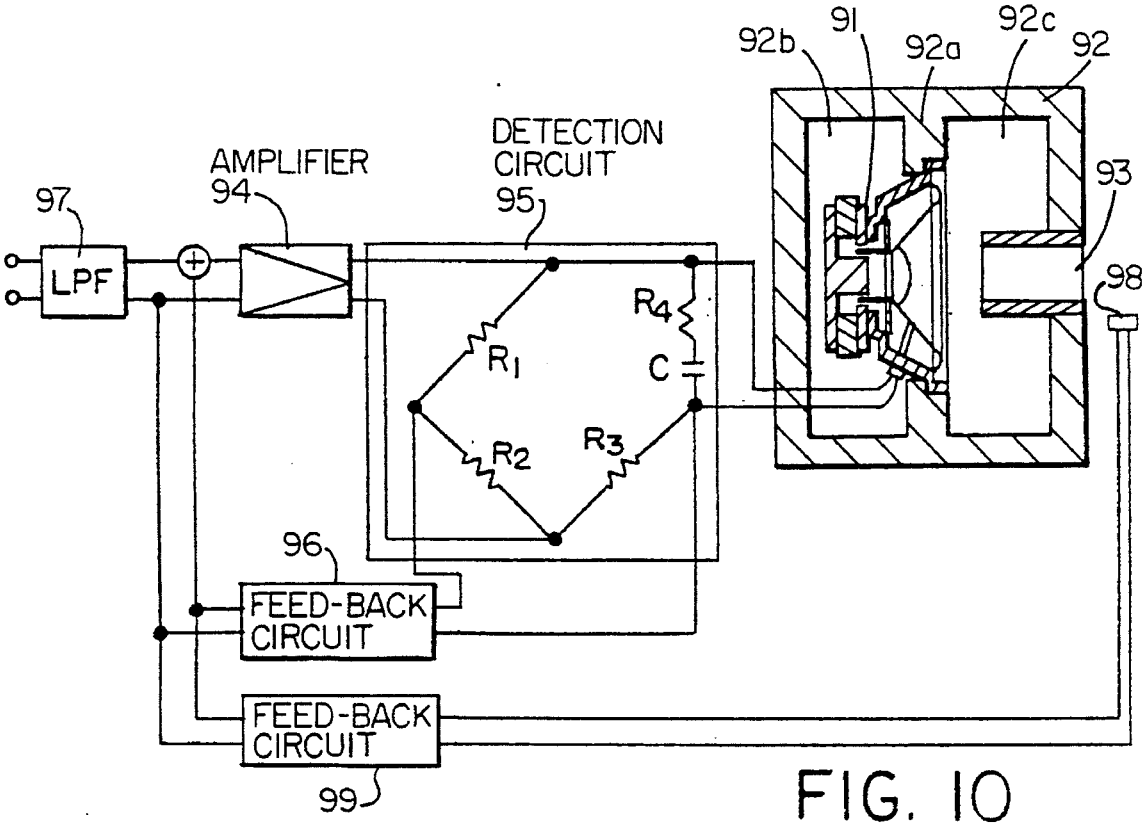
FIG. 10 is a block diagram showing a bass reproduction speaker apparatus in a tenth example of the present invention.

A tenth example of the present invention will be described with reference to FIG. 10. In FIG. 10, a speaker unit 91, a cabinet 92, a cavity division member 92*a*, a back cavity 92*b*, a front cavity 92*c*, an amplifier 94, a detection circuit 95, a first feedback circuit 96, and a low-pass filter 97 are the same as those in Example 9 with the exception that ten has been added to the respective reference numerals. The velocity-type MFB and the acceleration-type MFB which are similar to those in Example 9 are conducted. In particular, in the present example, a microphone 98 which is a second detection circuit for detecting the air vibration is given to a port 93, and the detection signal from the microphone 98 is fed back to the amplifier 94 by a second feedback circuit 99, whereby the acceleration-type MFB is conducted in the port 93. A back cavity 92*b* of a cabinet 92 has an internal volume of 2.75 liters in the same way as in Example 9. An internal volume of a front cavity 92*c* is made 2.4 liters; however, a substantial internal volume of the front cavity 92*c* excluding the volume of the port 93 is 2.1 liters which is the same as that in Example 9. As the microphone 98, an electret capacitor microphone with a size of ø10 mm×6 mm is used. The microphone 98 is attached to a face to which the port 93 is attached and in a position 30 mm away from an exit of the port 93. The reason for this is that when the microphone 98 is provided in front of the exit of the port 93, the air vigorously comes in and out of the port 93 at the time that a large sound pressure is generated, and air blowing noise of the microphone 98 is spread.

According to this structure, the speaker unit 91 operates in the same way as that in Example 9. In the case where the MFB is conducted in the port 93, the operation, which is the same as that in the case where the MFB is conducted in the passive radiator in Examples 5 and 6, can be obtained. More specifically, when the acceleration-type MFB is conducted in the port 93, the amplifier 94 operates so as to obtain an acceleration-frequency characteristic curve of air vibration in the port 93 with a constant sound pressure level. This is equivalent to the case where the effective moving mass of the air in the port 93 is made large and corresponds to the case where the port 93 is made longer. The effective moving mass of the air in the port 93 can equivalently be increased in a substantial amount by increasing the feedback amount.

In the present example, the port 93 has an inside diameter of ø36 mm in the same way as in Example 9. A length thereof is 220 mm and an effective moving mass of the air in the port 93 is 0.51 g. The detection signal of the microphone 98 is in proportion to a sound pressure of the port 93, and the sound pressure of the port 93 is in proportion to the velocity of the vibration of the air in the port 93. Thus, in the case where the acceleration-type MFB is conducted in the second feedback circuit 99, the level of the detection signal from the microphone 98 is determined by controlling the gain thereof so that the effective moving mass of the air in the port 93 equivalently becomes 0.75 g. When a signal with a high frequency is fed back by the MFB, the output signal of the amplifier becomes unstable, so that the feedback amount is attenuated in a high frequency band by providing a low-pass filter with a cutoff frequency of 800 Hz in the second feedback circuit 99.

Figure 23:
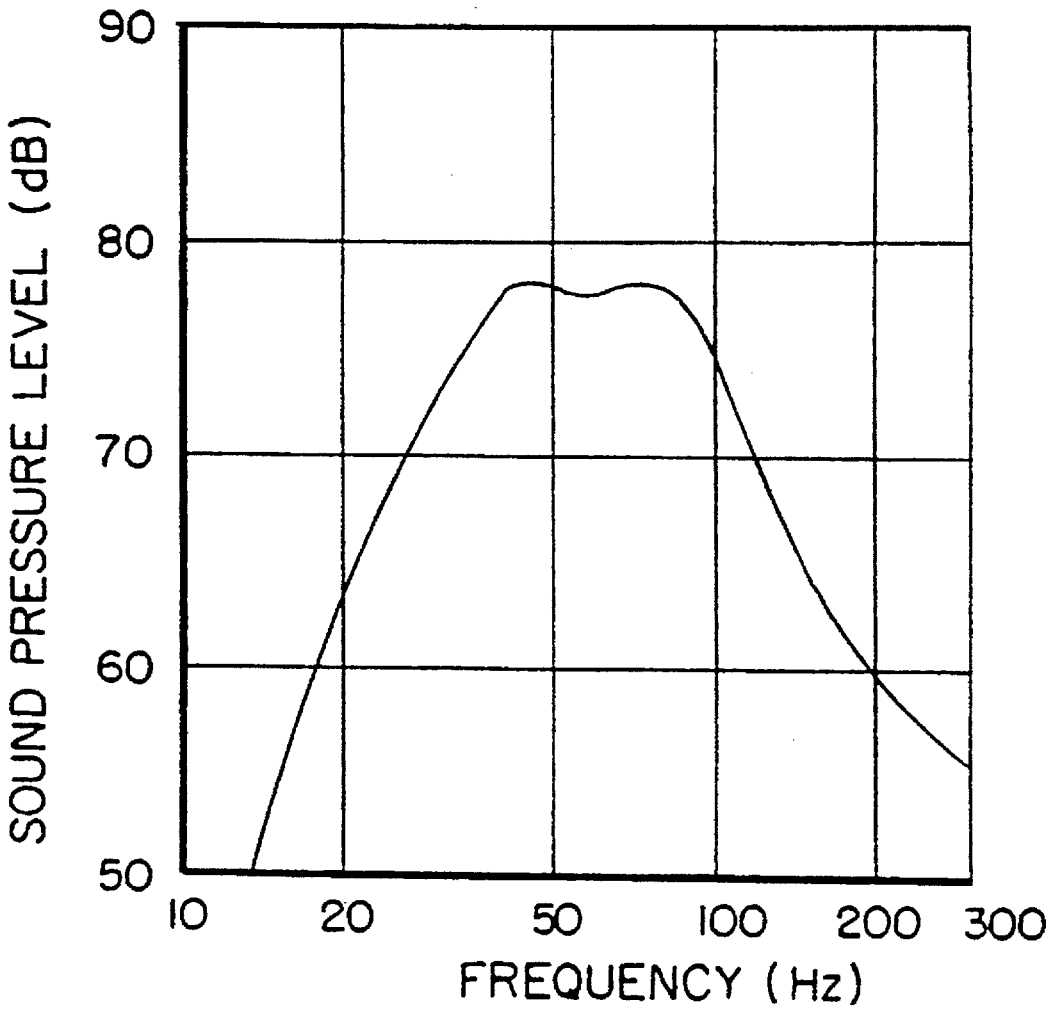
FIG. 23 is an actual measured sound pressure level-frequency characteristic curve of the bass reproduction speaker apparatus in the tenth example of the present invention.

An actual measured sound pressure level-frequency characteristic curve of the bass reproduction speaker apparatus thus fabricated is shown in FIG. 23. As is understood from FIG. 23, the characteristic curve has an almost flat shape between about 40 Hz and about 100 Hz. In addition, even though the total volume of the cabinet 92 is as small as 5.15 liters, a high practical maximum output sound pressure level of about 89 dB/meter is obtained at 40 Hz.

In the present example, the acceleration-type MFB alone is conducted in the port 93; however, the velocity-type MFB can also be conducted. Moreover, the microphone 98 is used for detecting the air vibration of the port 93. Instead of that, a hot-wire anemometer can be used.

Furthermore, in the present example, the detection circuit 95 is used for conducting the MFB in the speaker unit 91. Instead of that, a sensor or a microphone as described in Examples 1 and 2 can be used.

As described above, the same effects as those of Example 9 can be used. In addition, the acceleration-type MFB is conducted in the port 93 in the present example, so that the length of the port 93 can be shortened, resulting in a simplified incorporation of the port 93 into the cabinet 92 and a further simplified fabrication of the bass reproduction speaker apparatus.

Various other modifications wall be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A bass reproduction speaker apparatus, comprising:

a cabinet with an opening, having a division member inside thereof;

a speaker unit disposed at the division member;

a passive radiator disposed in the opening;

an amplifying means for driving the speaker unit;

a detection means for detecting motion of a moving system of the speaker unit; and a feedback means for feeding back an output signal from the detection means to the amplifying means, the feedback means conducting both a velocity-type motion feedback and an acceleration-type motion feedback simultaneously over the same frequency band such that the acceleration-type motion feedback substantially aligns a height of peaks in an output sound pressure level versus frequency response of the speaker apparatus at two resonance frequencies in a low frequency range with each other, and the velocity-type motion feedback suppresses the peaks to obtain a substantially flat output sound pressure level over a wide range of low frequencies.

2. A bass reproduction speaker apparatus according to claim 1, wherein the detection means is a sensor disposed at the moving system.

3. A bass reproduction speaker apparatus according to claim 1, wherein the detection means is a microphone.

4. A bass reproduction speaker apparatus according to claim 1, wherein the detection means is a detection circuit disposed between the amplifying means and the speaker unit.

5. A bass reproduction speaker apparatus according to claim 1, further comprising a second detection means for detecting a vibration of a moving system of the passive radiator; and a second feedback means for feeding back a detection signal from the second detection means to the amplifying means.

6. A bass reproduction speaker apparatus according to claim 1, wherein said bass reproduction speaker apparatus forms a band-pass type speaker.

7. A bass reproduction speaker apparatus according to claim 1, wherein the feedback means comprises a low-pass filter.

8. A bass reproduction speaker apparatus according to claim 7, wherein the feedback means further comprises an integrating circuit.

9. A bass reproduction speaker apparatus according to claim 7, wherein the feedback means further comprises a differentiating circuit.

10. A bass reproduction speaker apparatus according to claim 2, wherein the sensor generates a signal which is in proportion to an acceleration of the vibration of the moving system of the speaker unit.

11. A bass reproduction speaker apparatus according to claim 2, wherein the sensor generates a signal which is in proportion to a velocity of the vibration of the moving system of the speaker unit.

12. A bass reproduction speaker apparatus according to claim 2, wherein the sensor generates a signal which is in proportion to a displacement of the moving system of the speaker unit.

13. A bass reproduction speaker apparatus according to claim 5, wherein the second detection means is a microphone.

14. A bass reproduction speaker apparatus according to claim 5, wherein the second feedback means conducts a motional feedback.

15. A bass reproduction speaker apparatus according to claim 1, wherein said output signal comprises a voltage signal which is proportional to movement of said moving system.

16. A bass reproduction speaker apparatus, comprising:

a cabinet with an opening, having a division member inside thereof, the division member dividing the cabinet into a front cavity and a back cavity;

a first speaker unit disposed at the division member, the first speaker unit being placed inside the back cavity;

a second speaker unit disposed in the opening, the second speaker unit being placed within the front cavity, the second speaker unit acting passively in response to the first speaker unit;

an amplifying means for driving the first speaker unit;

a first detection means for detecting a vibration of the first speaker unit;

a first feedback means for feeding back an output signal from the first detection means to the amplifying means;

a second detection means for detecting a vibration of the second speaker unit; and a second feedback means for feeding back an output signal from the second detection means to the amplifying means, wherein the first feedback means conducts both a velocity-type motion feedback and an acceleration-type motion feedback simultaneously over the same frequency band such that the acceleration-type motion feedback substantially aligns a height of peaks in an output sound pressure level versus frequency response of the speaker apparatus at two resonance frequencies in a low frequency range with each other, and the velocity-type motion feedback suppresses the peaks to obtain a substantially flat output sound pressure level over a wide range of low frequencies.

17. A bass reproduction speaker apparatus according to claim 16, wherein the second detection means is a moving coil sensor of the second speaker unit.

18. A bass reproduction speaker apparatus according to claim 16, wherein a resonance occurs in both the front cavity and the back cavity for reproducing bass sound signals.

19. A bass reproduction speaker apparatus, comprising:

a cabinet with an opening, having a division member inside thereof, the division member forming a closed space inside the cabinet;

a speaker unit disposed at the division member, the back face of the speaker unit being disposed in the closed space;

a port provided in the opening;

an amplifying means for driving the speaker unit;

a detection means for detecting a vibration of a moving system of the speaker unit; and a feedback means for feeding back an output signal from the detection means to the amplifying means, the feedback means conducting both a velocity-type motion feedback and an acceleration-type motion feedback simultaneously over the same frequency band such that the acceleration-type motion feedback substantially aligns a height of peaks in an output sound pressure level versus frequency response of the speaker apparatus at two resonance frequencies in a low frequency range with each other, and the velocity-type motion feedback suppresses the peaks to obtain a substantially flat output sound pressure level over a wide range of low frequencies.

20. A bass reproduction speaker apparatus according to claim 19, further comprising a second detection means for detecting a vibration of the air in the port; and a second feedback means for feeding back an output signal from the second detection means to the amplifying means.

21. A bass reproduction speaker apparatus, comprising:

a speaker unit driven by an amplifier, the amplifier for driving the speaker unit as a function of a feedback signal;

a detection means for detecting movement of the speaker unit as a result of the amplifier, and for producing the feedback signal as a function of the movement, wherein the detection means comprises a detector selected from a group consisting of a microphone, a piezoelectric sensor, a moving coil sensor, a light quantity detection sensor, a laser Doppler sensor, and an electrostatic sensor; and a feedback means for feeding back the feedback signal from the detection means to the amplifying means, the feedback means conducting both a velocity-type motion feedback and an acceleration-type motion feedback simultaneously over the same frequency band such that the acceleration-type motion feedback substantially aligns a height of peaks in an output sound pressure level versus frequency response of the speaker apparatus at two resonance frequencies in a low frequency range with each other, and the velocity-type motion feedback suppresses the peaks to obtain a substantially flat output sound pressure level over a wide range of low frequencies.

22. A bass reproduction speaker apparatus, comprising:

a cabinet which has openings on respective opposing sides thereof and has division members inside thereof;

passive radiators provided in the respective openings;

a speaker unit disposed between the division members, the main axis of radiation of the speaker unit being perpendicular to the axes of radiation of the passive radiators;

an amplifying means for driving the speaker unit;

a detection means for detecting a vibration of a moving system of the speaker unit; and a feedback means for feeding back an output signal from the detection means to the amplifying means.

23. A bass reproduction speaker apparatus according to claim 22, wherein the passive radiators provided in the respective openings have the same effective moving mass and effective diaphragm area.

* * * * *